US006975271B2

(12) United States Patent
Adachi et al.

(10) Patent No.: US 6,975,271 B2
(45) Date of Patent: Dec. 13, 2005

(54) ANTENNA SWITCH MODULE, ALL-IN-ONE COMMUNICATION MODULE, COMMUNICATION APPARATUS AND METHOD FOR MANUFACTURING ANTENNA SWITCH MODULE

(75) Inventors: Masakazu Adachi, Osaka (JP); Kazuhide Uriu, Osaka (JP); Toshio Ishizaki, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 21 days.

(21) Appl. No.: 10/786,434

(22) Filed: Feb. 25, 2004

(65) Prior Publication Data

US 2004/0227666 A1 Nov. 18, 2004

(30) Foreign Application Priority Data

Feb. 26, 2003 (JP) ..... 2003-049803

(51) Int. Cl.[7] ..... H01Q 1/26

(52) U.S. Cl. ..... 343/700 MS; 333/103; 333/262; 455/19

(58) Field of Search ..... 343/700 MS; 333/103, 333/262; 455/19

(56) References Cited

U.S. PATENT DOCUMENTS

| | | | | |
|---|---|---|---|---|
| 5,774,792 | A * | 6/1998 | Tanaka et al. | 455/78 |
| 6,862,436 | B2 * | 3/2005 | Hayakawa et al. | 455/121 |
| 2002/0024375 | A1 * | 2/2002 | Asano et al. | 327/365 |
| 2004/0032706 | A1 * | 2/2004 | Kemmochi et al. | 361/306.3 |
| 2004/0075491 | A1 * | 4/2004 | Kushitani et al. | 330/51 |
| 2004/0113713 | A1 * | 6/2004 | Zipper et al. | 333/103 |

FOREIGN PATENT DOCUMENTS

| | | |
|---|---|---|
| EP | 1 223 634 A2 | 7/2002 |
| JP | 07-202502 | 8/1995 |
| JP | 07-202504 | 8/1995 |
| JP | 10-276003 | 10/1998 |
| JP | 2001-285112 | 10/2001 |
| JP | 2001-352271 | 12/2001 |

* cited by examiner

*Primary Examiner*—Hoang V. Nguyen
*Assistant Examiner*—Marie Antoinette Cabucos
(74) *Attorney, Agent, or Firm*—RatnerPrestia

(57) ABSTRACT

To realize high pressure-tightness and improvement in a high-frequency characteristic due to a low impedance between a shunt FET and a ground of a FET switch circuit. An antenna switch module comprising a switch circuit for switching between transmitting and receiving of a signal between an antenna and a transmitting portion and/or a receiving portion and having a shunt circuit, wherein a capacitor of the shunt circuit of the switch circuit is provided to a dielectric layered body, and remaining elements of the switch circuit are provided to semiconductor chips mounted on the dielectric layered body.

18 Claims, 19 Drawing Sheets

ANTENNA SWITCH MODULE, ALL-IN-ONE COMMUNICATION MODULE, COMMUNICATION APPARATUS AND METHOD FOR MANUFACTURING ANTENNA SWITCH MODULE

BACKGROUND OF THE INVENTION

1. Filed of the Invention

The present invention relates to an antenna switch module, an all-in-one communication module, a communication apparatus and a method for manufacturing the antenna switch module. For instance, it relates to antenna switch modules for high-frequency and high-power signals.

2. Related Art of the Invention

In recent years, there has been a demand for a portable telephone supporting a multi band capable of using a plurality of methods. The reason for this is an expanding user base of mobile communication such as portable telephones and globalization. For instance, there is a demand for a triple-band portable telephone using three communication methods of different frequency bands of ESGM (Enhanced-Global System for Mobile Communication) method mainly used in Europe, a DCS (Digital Cellular System) method increasingly used in conjunction with the expanding user base of portable telephones and a PCS (Personal Communication Services) method mainly used in the U.S.A. Furthermore, there is a demand for a quad-band portable telephone adding UMTS (Universal Mobile Telecommunication System) which implements next-generation high-speed communication.

For that reason, development is underway antenna switches using FET switches comprised of GaAs-field-effect transistors (hereafter, FETs) capable of easily supporting the trend toward multi band.

As shown in FIG. 19, an antenna switch 40 in the prior art has a semiconductor chip 46 mounted on a surface of a dielectric layered body 45, and the semiconductor chip 46 is mounted on a land electrode pattern for dies bond formed on the dielectric layered body 45 (refer to Japanese Patent Laid-Open No. 2001-285112, pp. 3 to 4, FIGS. 1 and 4, for instance). The disclosure of the above document is incorporated herein by reference in its entirety. The portion indicated by a dashed line in the upper portion of the dielectric layered body 45 in FIG. 19 is the portion to be resin-sealed, and FIG. 19 is a diagram seeing through this resin 44 portion. In addition, the semiconductor chip 46 is comprised of one semiconductor chip. However, it may be comprised of two or more separate semiconductor chips for a switch portion and a logic portion.

FIG. 7 is an equivalent circuit diagram of FET switch operating as SPST (Single-Pole Single-Throw) which is a very basic antenna switch circuit. In an FET switch 10 indicated by a range enclosed by an alternate long and short dash line in FIG. 7, an FET 16 providing a shunt circuit is connected to ground via a capacitor 17. The FET switch 10 in the prior art used as the capacitor 17 an MIM (Metal-Insulator-Metal) capacitor formed in the semiconductor chip.

The capacitor 17 is formed in the semiconductor chip by using the MIM capacitor for the following reason. To be more specific, if an impedance between the FET of the shunt circuit and the ground in the antenna switch circuit becomes high, a ground potential of the FET of the shunt circuit becomes high on operation and a high-frequency characteristic deteriorates. Thus, as shown in FIG. 7, wiring Ls1 between the FET 16 and the capacitor 17 is rendered as small as possible in order to reduce a parasitic inductance contributing to the impedance due to a wiring Ls between the FET and the ground for the sake of preventing the impedance from becoming higher. In the case of mounting the capacitor 17 on the top surface of the dielectric layered body 45, the wiring routed on the dielectric layered body 45 becomes so long that a distance L1 cannot be short. For that reason, the capacitor 17 is formed in the semiconductor chip in which the FET is formed so as to render the wiring Ls1 shortest, and thus a wiring L shortest.

The above-mentioned antenna switch in the prior art uses an MIM capacitor formed in the semiconductor chip as a capacitor for connecting an FET of a shunt circuit to a ground. The MIM capacitor is generally a parallel plate type capacitor sandwiching an insulator such as $SiO_2$ or SiN of 0.2 to 0.3 $\mu$m thickness with a conductive material such as Au. Therefore, there is a problem that, if an electrostatic surge of 300V or so gets in from the outside, the capacitor connected to the FET of the shunt circuit is destroyed so that it no longer functions as the switch.

The present invention resolves the problem in the prior art, and an object thereof is to provide an antenna switch module, an all-in-one communication module, a communication apparatus and a method for manufacturing the antenna switch module, wherein the capacitor is not destroyed and a high-frequency characteristic does not deteriorate even in the case where a high-voltage signal such as the electrostatic surge flows in.

SUMMARY OF THE INVENTION

The $1^{st}$ aspect of the present invention is an antenna switch module comprising a switch circuit for switching between transmitting and/or receiving of a signal between an antenna and a transmitting portion and/or a receiving portion and having a shunt circuit, wherein a capacitor of the shunt circuit of said switch circuit is provided to a dielectric layered body, and remaining elements of said switch circuit are provided to a semiconductor chip mounted on said dielectric layered body.

The $2^{nd}$ aspect of the present invention is the antenna switch module according to the $1^{st}$ aspect of the present invention, wherein said semiconductor chip is mounted face down on a top surface of said dielectric layered body.

The $3^{rd}$ aspect of the present invention is the antenna switch module according to the $2^{nd}$ aspect of the present invention, wherein an electrical connection between said semiconductor chip and said dielectric layered body is made in a surface of said semiconductor chip if projectively viewed from the top surface of said dielectric layered body.

The $4^{th}$ aspect of the present invention is the antenna switch module according to the $1^{st}$ aspect of the present invention, wherein said semiconductor chip is mounted by wire bonding.

The $5^{th}$ aspect of the present invention is the antenna switch module according to the $2^{nd}$ or the $4^{th}$ aspects of the present invention, wherein said dielectric layered body has a plurality of dielectric sheets including a first dielectric sheet on which a first electrode pattern connected to a ground potential is formed and a second dielectric sheet on which a second electrode pattern placed opposite said first electrode pattern is formed, and said capacitor is formed between said first electrode pattern and said second electrode pattern.

The $6^{th}$ aspect of the present invention is the antenna switch module according to the $5^{th}$ aspect of the present invention, wherein said first electrode pattern is provided closer to said semiconductor chip than said second electrode pattern in said dielectric layered body.

The $7^{th}$ aspect of the present invention is the antenna switch module according to the $5^{th}$ aspect of the present invention, wherein said second electrode pattern is provided closer to said semiconductor chip than said first electrode pattern in said dielectric layered body.

The $8^{th}$ aspect of the present invention is the antenna switch module according to the $2^{nd}$ or the $4^{th}$ aspects of the present invention, wherein said first dielectric sheet is placed on said dielectric layered body except its top layer, and said first electrode pattern has a shape for including at least the entire contours of said semiconductor chip if projectively viewed from the top surface of said dielectric layered body.

The $9^{th}$ aspect of the present invention is the antenna switch module according to the $8^{th}$ aspect of the present invention, wherein, on said dielectric layered body, a third electrode pattern formed on a third dielectric sheet placed on said first dielectric sheet overlapping said first electrode pattern if projectively viewed from the top surface is connected to a fourth electrode pattern formed on a fourth dielectric sheet placed under said first dielectric sheet through an opening formed on said first electrode pattern so as not to short the ground potential.

The $10^{th}$ aspect of the present invention is the antenna switch module according to the $7^{th}$ aspect of the present invention, wherein said third electrode pattern is connected to an arbitrary terminal of said semiconductor chip, and said fourth electrode pattern is the same as said second electrode pattern.

The $11^{th}$ aspect of the present invention is the antenna switch module according to the $1^{st}$ aspect of the present invention, wherein said switch circuit has one pair or a plurality of pairs of a first field-effect transistor and a second field-effect transistor, and each of said pairs has a drain terminal of said first field-effect transistor connected to a source terminal of said second field-effect transistor and the drain terminal of said second field-effect transistor connected to a ground potential via said capacitor.

The $12^{th}$ aspect of the present invention is the antenna switch module according to the $1^{st}$ aspect of the present invention, wherein said switch circuit has one pair or a plurality of pairs of a first field-effect transistor and a second field-effect transistor, and each of said pairs has a source terminal of said first field-effect transistor connected to a drain terminal of said second field-effect transistor and the source terminal of said second field-effect transistor connected to a ground via said capacitor.

The $13^{th}$ aspect of the present invention is the antenna switch module according to the $5^{th}$ aspect of the present invention, wherein a combination of electrode patterns of certain dielectric sheets of said plurality of dielectric sheets forming said dielectric layered body forms one high-frequency filter or a plurality of high-frequency filters.

The $14^{th}$ aspect of the present invention is the antenna switch module according to the $13^{th}$ aspect of the present invention, wherein said first electrode pattern has a shape for including all the electrode patterns of said certain dielectric sheets forming said high-frequency filters if projectively viewed from the top surface of said dielectric layered body.

The $15^{th}$ aspect of the present invention is an all-in-one communication module comprising:

the antenna switch module according to the $1^{st}$ aspect of the present invention;

a low-pass filter of said transmitting portion provided in said dielectric layered body; and a power amplifier for supplying a transmitting signal to said low-pass filter provided on said dielectric layered body.

The $16^{th}$ aspect of the present invention is the all-in-one communication module according to the $15^{th}$ aspect of the present invention, further comprising:

a band pass filter of said receiving portion provided in said dielectric layered body; and a voltage-controlled oscillator for supplying a transmitting signal to said power amplifier on the transmitting side provided on said dielectric layered body.

The $17^{th}$ aspect of the present invention is a communication apparatus comprising:

the antenna switch module according to the $1^{st}$ aspect of the present invention;

an antenna connected to said antenna switch module;

the transmitting portion for supplying the transmitting signal to said antenna switch module; and the receiving portion.

The $18^{th}$ aspect of the present invention is a communication apparatus comprising:

the all-in-one communication module according to any one of the $15^{th}$ and the $16^{th}$ aspects of the present invention; and an antenna connected to said low-pass filter and/or said band pass filter.

The $19^{th}$ aspect of the present invention is a method for manufacturing an antenna switch module comprising a switch circuit for switching between transmitting and receiving of a signal between an antenna and a transmitting portion or a receiving portion and having a shunt circuit, wherein the method has the steps of:

placing a capacitor of the shunt circuit of said switch circuit on a dielectric layered body; and placing remaining elements of said switch circuit on a semiconductor chip mounted on said dielectric layered body.

The $20^{th}$ aspect of the present invention is the method for manufacturing the antenna switch module according to the $19^{th}$ aspect of the present invention, wherein said semiconductor chip is mounted face down on a top surface of said dielectric layered body.

The $21^{st}$ aspect of the present invention is the method for manufacturing the antenna switch module according to the $19^{th}$ or the $20^{th}$ aspects of the present invention, wherein said dielectric layered body is manufactured by laminating a plurality of dielectric sheets including a first dielectric sheet on which a first electrode pattern connected to a ground potential is formed and a second dielectric sheet on which a second electrode pattern placed opposite said first electrode pattern is formed, and said capacitor is formed between said first electrode pattern and said second electrode pattern.

DESIGNATION OF REFERENCE NUMERALS

Figure 1:
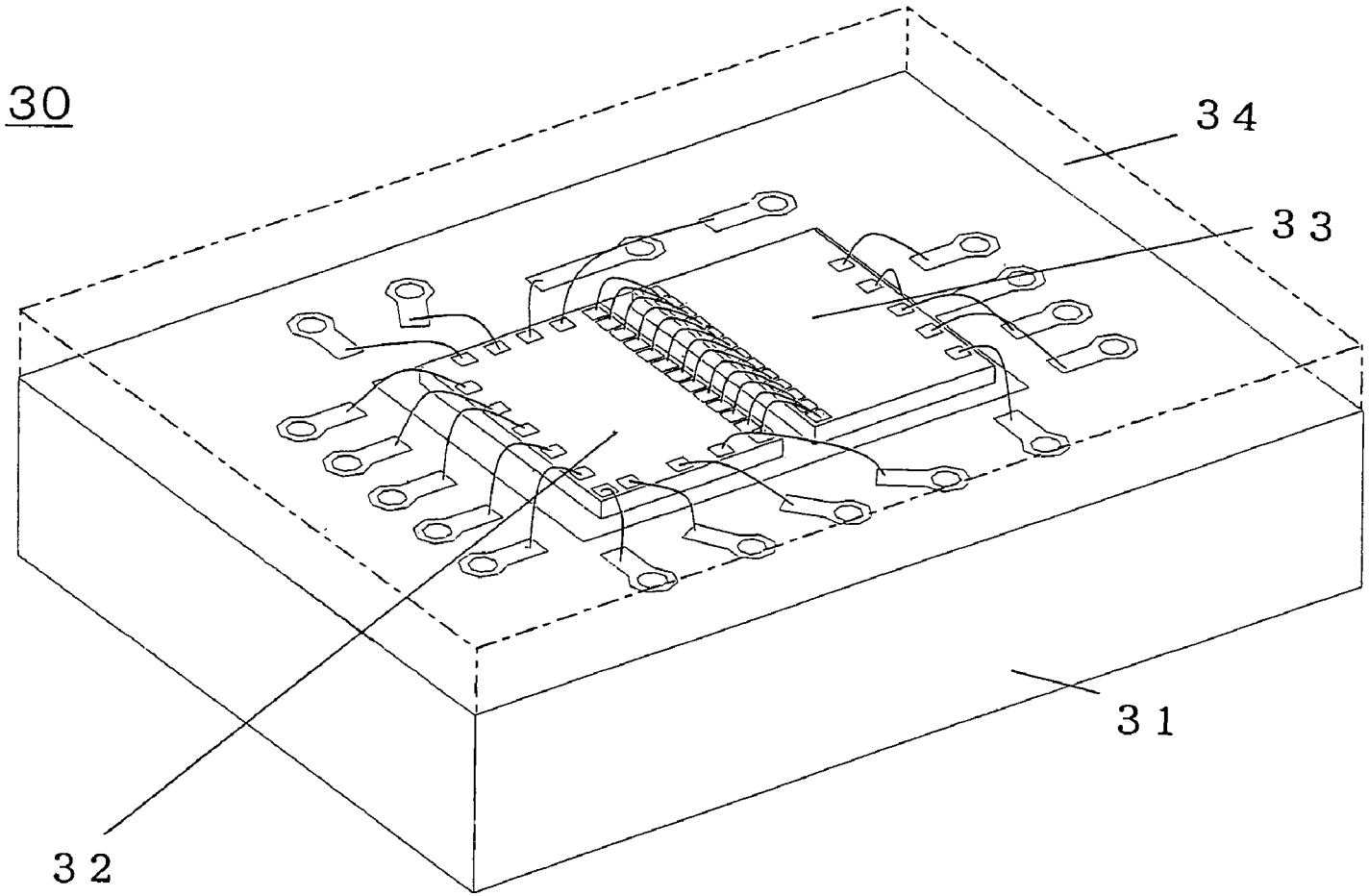
FIG. 1 is a perspective view of an antenna switch module according to a first embodiment of the present invention.

10, 22 Switch circuits
13, 23 Antennas
15, 16, 24*a* to 24*d*, 25*a* to 25*d* FETs
17, 18, 19, 47, 48, 49 DC cut capacitors
20, 21 Receiving portions
24, 25 FET groups
30, 40, 50 Antenna switch modules
31, 45, 51 Dielectric layered bodys
32, 33, 46, 52, 53 Semiconductor chips
34, 44 Resins
35 Electrode pattern
36, V1, V2 Via hole electrode patterns
37 High-frequency filter
Dp1 Land electrode pattern for dies bond
Cp1 to Cp6, Cp11 to Cp16 Capacitor electrode patterns
Gp1, Gp2, Gp5 Earthed electrode pattern
G11, G12, G21, G22 Gate terminals
L1 to L5, L101 to L103 Dielectric layers
Lp1 to 17, Lp20 Stripline electrode patterns
P1 to P3, P11 to P13 High-frequency signal input-output terminal
Sp1 to Sp7, Sp10 Spacer patterns
T1, TG, TS, TR Under surface ground electrode patterns

PREFERRED EMBODIMENTS OF THE INVENTION

Hereafter, preferred embodiments of the present invention will be described based on the attached drawings.

(First Embodiment)

FIG. 1 is a perspective view of an antenna switch module 30 according to a first embodiment of the present invention. The antenna switch module 30 according to the first embodiment is comprised of a dielectric layered body 31 obtained by laminating and integrally burning a plurality of dielectric layers and a switch semiconductor chip 32 and a logic semiconductor chip 33 mounted on a top surface of the dielectric layered body 31. Electrode patterns are formed on the top surface, under surface and inside of the dielectric layered body 31 respectively. The portion indicted by a dashed line in the upper part of the dielectric layered body 31 in FIG. 1 is the portion to be resin-sealed, and FIG. 1 is a diagram seeing through this resin 34 portion.

Figure 2:
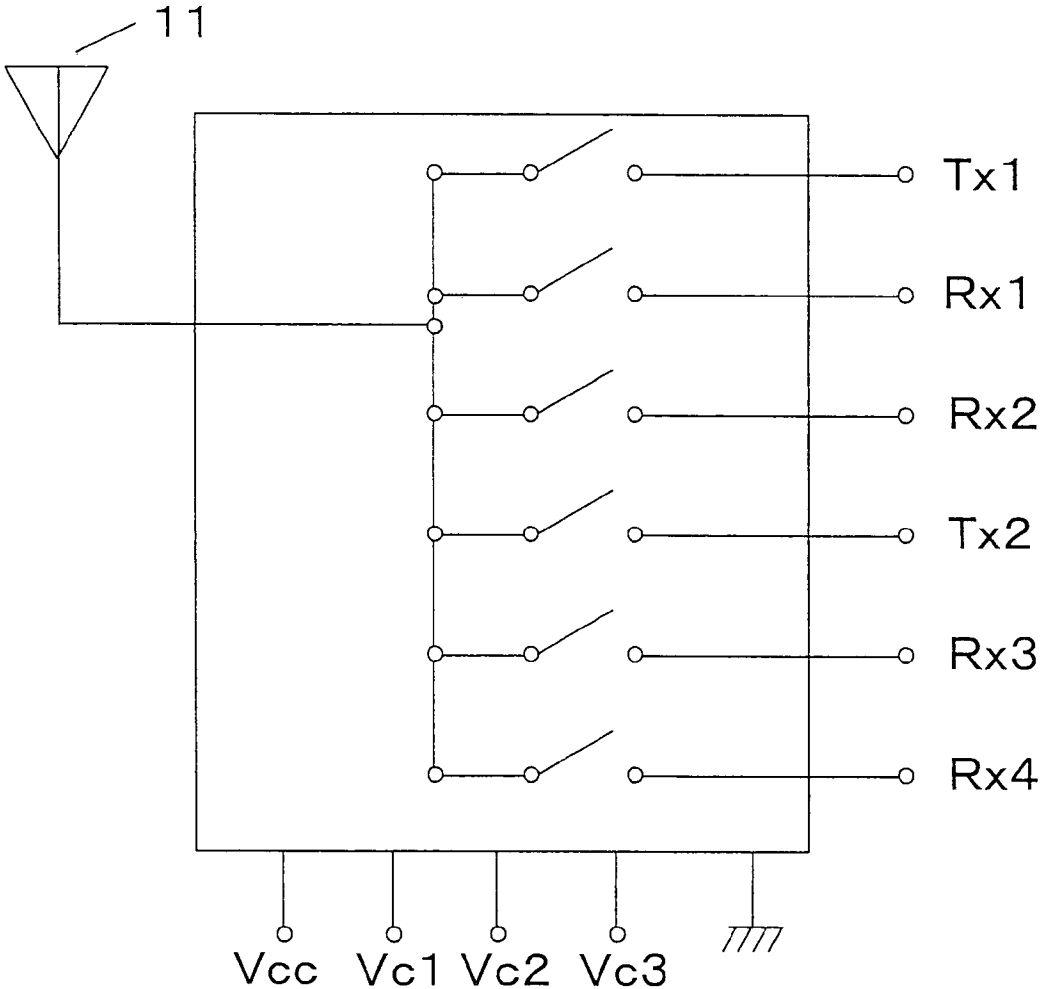
FIG. 2 is a block diagram of the antenna switch module according to the first embodiment of the present invention.

FIG. 2 is a block diagram of an SP6T (Single-Pole 6-Throw) antenna switch of the antenna switch module 30 according to the first embodiment. The SP6T antenna switch in FIG. 2 has a function of switching a route from two types of transmitting signals and four types of receiving signals to an antenna 11. Six switch conditions are switched by combinations of Vc1, Vc2 and Vc3 voltages. For instance, the SP6T antenna switch can switch among six routes of the transmitting signals in GSM (Global System for Mobile Communication) 850 and GSM 900 bands, receiving signals in the GSM 850 band, receiving signals in the GSM 900 band, transmitting signals in a DCS (Digital Cellular System) band and a PCS (Personal Communication Services) band, receiving signals in the DCS band and receiving signals in the PCS band. In FIG. 1, the antenna switch module 30 is comprised of the switch semiconductor chip 32, logic semiconductor chip 33, dielectric layered body 31 containing a capacitor for connecting the switch semiconductor chip 32 to a ground and resin 34 for resin sealing.

An example of a method for manufacturing the dielectric layered body 31 will be described. The dielectric layered body may be manufactured by using a dielectric material of an A1-Mg—Si—Gd—O system. First, a plurality of via holes are made by using mechanical punching or a laser process on green sheets made by molding slurry obtained by mixing the ceramic powder with an organic binder and an organic solvent. Next, a conductive paste of which main component is Ag (or a conductive material of low resistance such as Au or Cu) is filled in the via holes for interlayer-connecting wiring patterns formed on the green sheets. And the wiring patterns are formed on the green sheets by a screen printing method so as to form a stripline electrode pattern and a capacitor electrode pattern.

Next, a plurality of green sheets obtained as above are correctly aligned, laminated in order and warmed and pressurized under predetermined conditions so as to obtain an integrated dielectric layered body. The dielectric layered body is dried and is then burned at 400 to 500 degrees C. in a burning furnace in an oxidized atmosphere so that the organic binders in the green sheets are burned out. Next, a final dielectric layered body 31 is obtained by burning the dielectric layered body in a temperature range of approximately 850 to 950 degrees C. in the ordinary air in the case of using the powder of Au or Ag as the main component of the conductive material or in an inactive gas or a reducing atmosphere in the case of using the powder of Cu.

The electrode patterns formed in the dielectric layers will now be described.

Figure 3:
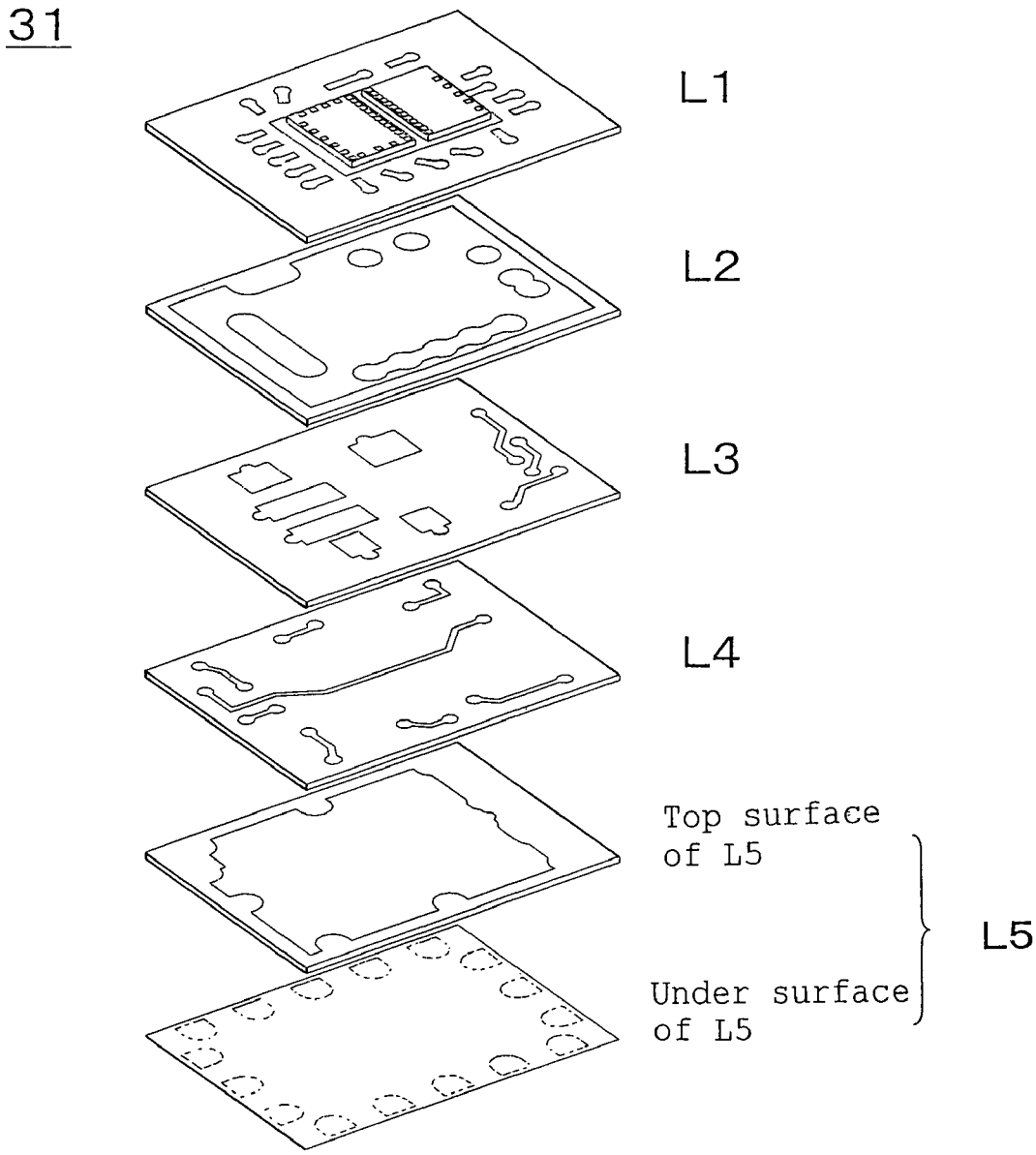
FIG. 3 is an exploded perspective view of the antenna switch module according to the first embodiment of the present invention.

FIG. 3 is an exploded perspective view showing a specific configuration of the antenna switch module according to the first embodiment. The dielectric layered body 31 is formed by five dielectric layers of dielectric layers L1 to L5 which are examples of a plurality of dielectric sheets of the present invention. In FIG. 3, the dielectric layers L1 to L4 are the diagrams viewed from the top surface, and the diagrams of the top surface and the under surface are shown as to the dielectric layer L5. The electrode pattern in the diagram of the under surface of the dielectric layer L5 in FIG. 3 shows a position seen through from the top surface.

Figure 4:
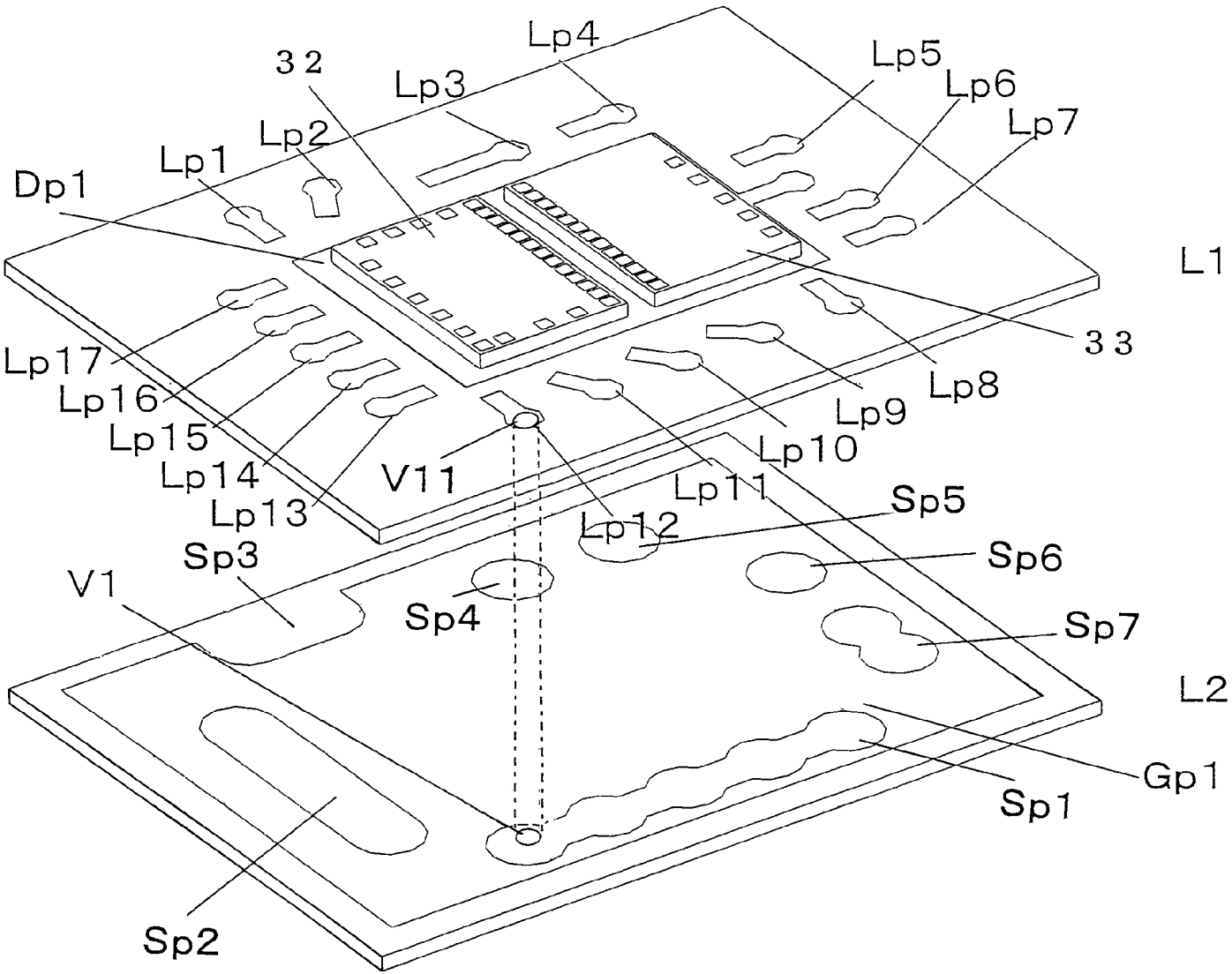
FIG. 4 is a diagram showing the dielectric layers L1 and L2 of the antenna switch module according to the first embodiment of the present invention.

FIG. 4 is an exploded perspective view showing the dielectric layer L1 as a topmost electrode layer forming the dielectric layered body 31 and the dielectric layer L2 as a second electrode layer from the top.

In FIG. 4, on the top surface of the dielectric layer L1, there are a land electrode pattern for dies bond Dp1 for mounting the switch semiconductor chip 32 and logic semiconductor chip 33, and stripline electrode patterns Lp1 to Lp17 comprising a land electrode pattern for wire bonding and a via land electrode pattern formed. The land electrode pattern for dies bond Dp1 and the stripline electrode patterns Lp1 to Lp17 are formed by printing and patterning the aforementioned conductive paste.

The stripline electrode patterns Lp1 to Lp17 and the land electrode pattern for dies bond Dp1 have via hole electrodes punched thereon respectively. On the top surface of the dielectric layers L2, an earthed electrode pattern Gp1 is formed by printing, which has larger area than the land electrode pattern for dies bond Dp1 formed on the top surface of the dielectric layer L1. On the earthed electrode pattern Gp1, spacer patterns Sp1 to Sp7 are formed in its electrode surface for the sake of punching the via hole electrodes not shorting the earthed electrode pattern Gp1. The land electrode pattern for dies bond Dp1 of the dielectric layer L1 is connected to the earthed electrode pattern Gp1 of a dielectric layers L2 via the plurality of via hole electrodes.

Figure 5:
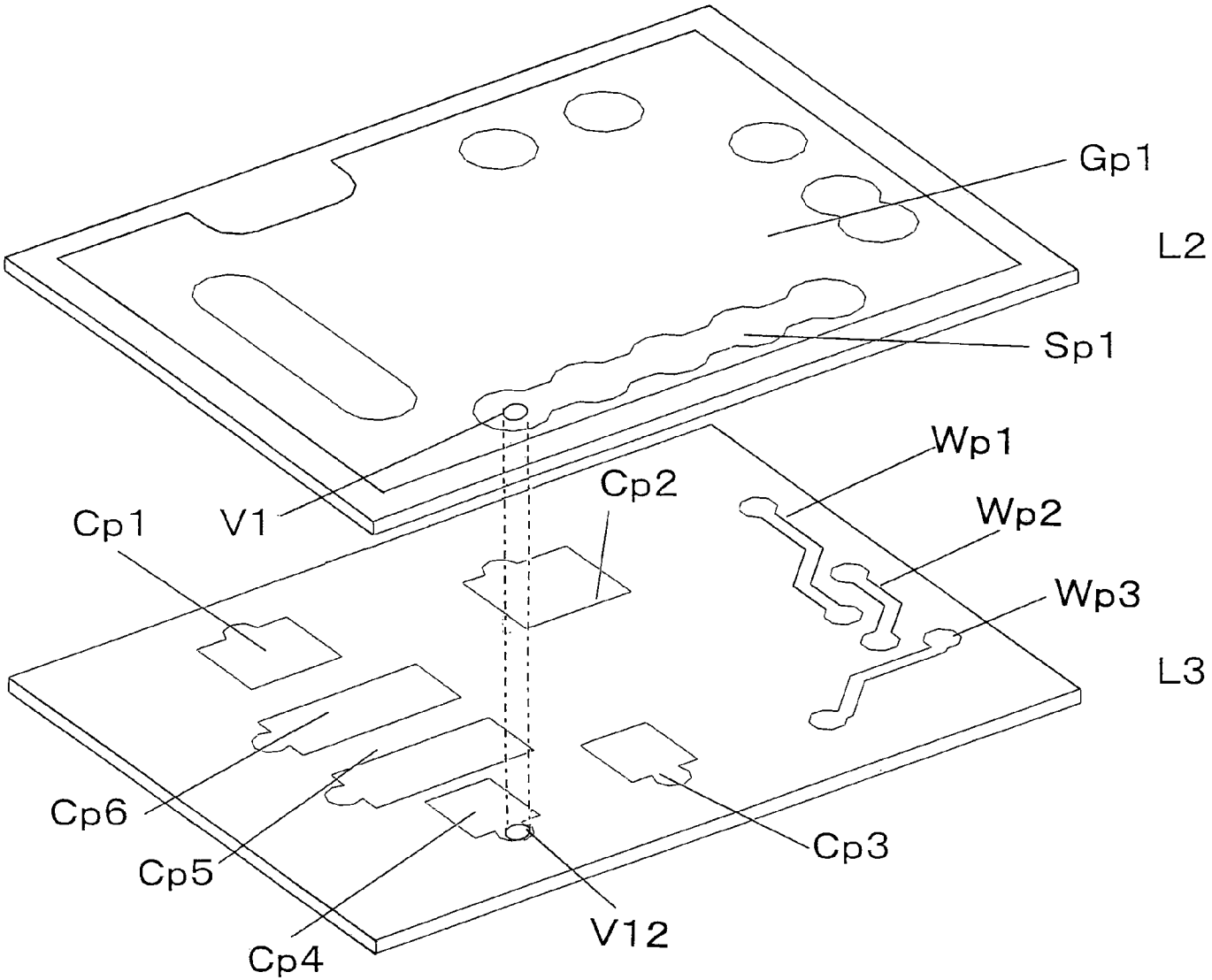
FIG. 5 is a diagram showing the dielectric layers L2 and L3 of the antenna switch module according to the first embodiment of the present invention.

FIG. 5 is an exploded perspective view showing the dielectric layer L2 as a second electrode layer from the top and a dielectric layer L3 as a third electrode layer from the top, which form the dielectric layered body 31.

In FIG. 5, on the top surface of the dielectric layer L3, there are capacitor electrode patterns Cp1 to Cp6 and wiring electrode patterns Wp1 to Wp3 necessary for connecting the stripline electrode patterns formed on the top surface of the dielectric layer L1 to under surface electrode patterns T1 mentioned later formed by printing. The capacitor electrode patterns Cp1 to Cp6 are connected by the via hole electrodes to the stripline electrode patterns Lp1, Lp3, Lp10, Lp12, Lp14 and Lp16 formed on the top surface of the dielectric layer L1 respectively.

A description will be given by using FIGS. 4 and 5 as to a connection between the stripline electrode pattern Lp12 and the capacitor electrode pattern Cp4 for instance. The stripline electrode pattern Lp12 includes a via land electrode pattern V11 with a 125 $\mu$m radius, and the capacitor electrode pattern Cp4 includes a via land electrode pattern V12 with a 125 $\mu$m radius. And the spacer pattern Sp1 formed on the earthed electrode pattern Gp1 has a via hole electrode pattern V1 with a 150 $\mu$m radius punched thereon. The via land electrode pattern V11 is connected to the via land electrode pattern V12 via the via hole electrode pattern V1 so that the stripline electrode pattern Lp12 is connected to the capacitor electrode pattern Cp4.

The spacer pattern Sp1 has a shape of a string of circular spacer patterns with a 300 $\mu$m radius centering on the via land electrode pattern. The capacitor electrode pattern Cp4 is placed opposite the earthed electrode pattern Gp1 except the area projectively overlapping the spacer pattern Sp1. Thus, a capacitor C4 is formed by the capacitor electrode pattern Cp4 and the earthed electrode pattern Gp1. Likewise, capacitors C1 to C6 are formed by the capacitor electrode patterns Cp1 to Cp6 and the opposite earthed electrode pattern Gp1 respectively.

Here, the dielectric layer L2 is an example of the first dielectric sheet of the present invention, and the earthed electrode pattern Gp1 formed on the dielectric layer L2 is an example of the first electrode pattern of the present invention. The dielectric layer L3 is an example of the second dielectric sheet of the present invention, and the capacitor electrode patterns Cp1 to Cp6 formed on the dielectric layer L3 are an example of the second electrode pattern of the present invention. And the capacitors C1 to C6 are an example of the capacitors of a shunt circuit provided to the dielectric layered body of the present invention. And the spacer patterns Sp1 to Sp7 are an example of openings formed on the first electrode pattern of the present invention.

Figure 6:
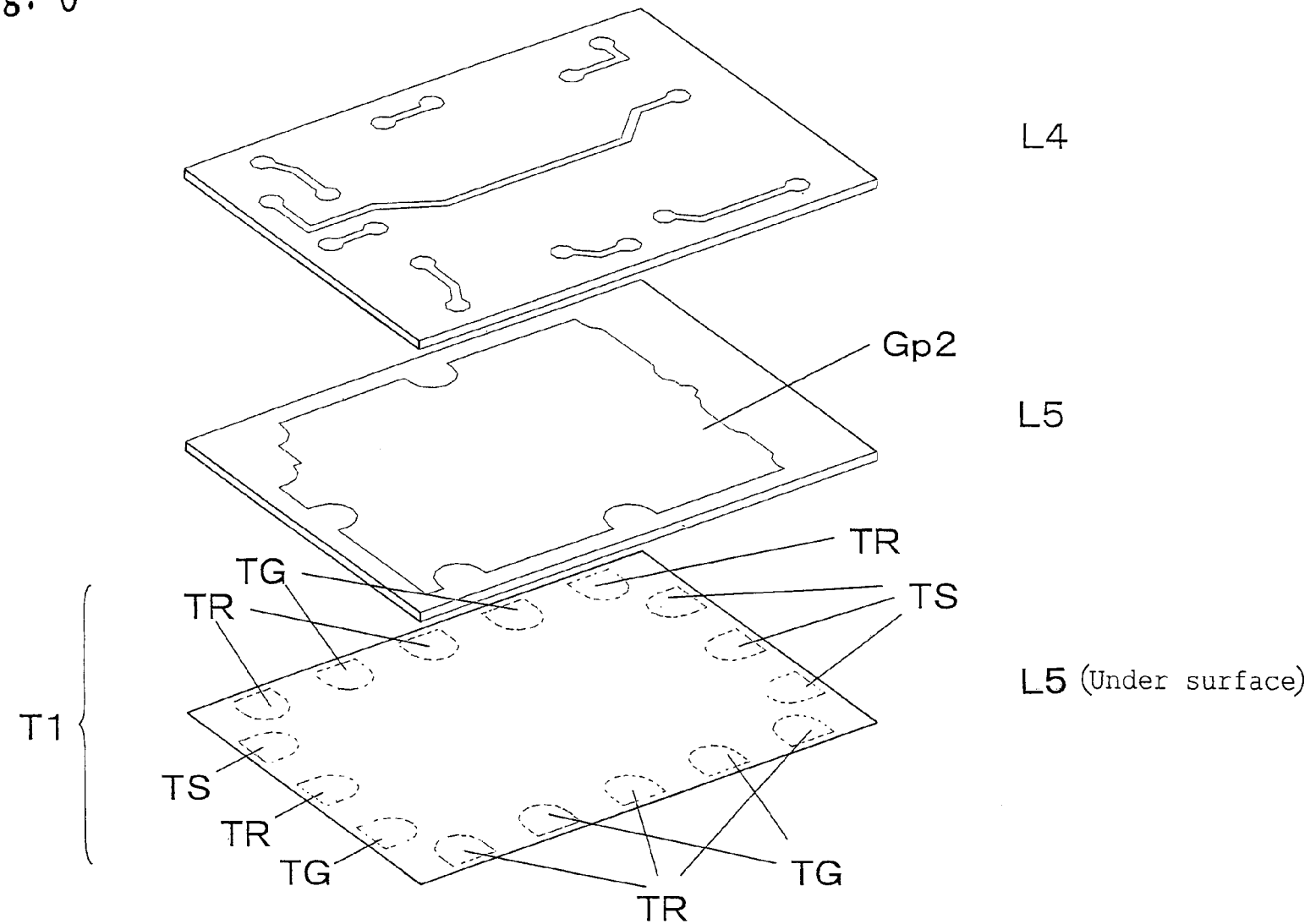
FIG. 6 is a diagram showing the dielectric layers L4 and L5 of the antenna switch module according to the first embodiment of the present invention.

FIG. 6 is an exploded perspective view showing the dielectric layer L5 as a lowermost electrode layer forming the dielectric layered body 31 and the dielectric layer L4 as a fourth electrode layer from the top. The dielectric layer L5 is the electrode layer having the electrode patterns on both surfaces, and the diagrams of the top surface and the under surface are shown as to the dielectric layer L5. The electrode pattern in the diagram of the under surface of the dielectric layer L5 in FIG. 6 shows a position seen through from the top surface.

In FIG. 6, an earthed electrode pattern Gp2 is formed on the top surface of the dielectric layer L5, and T1 comprised of a plurality of under surface electrode patterns for surface-mounting the dielectric layered body 31 on a main substrate is formed by printing on the under surface thereof. The under surface electrode patterns T1 are comprised of a plurality of under surface ground electrode patterns TG, RF signal under surface electrode patterns TR and control signal under surface electrode patterns TS.

On the top surface of the dielectric layer L4, there are the wiring electrode patterns necessary for connecting the electrode pattern formed on the top surface of the dielectric layer L1 to the under surface electrode patterns T1 formed by printing. The earthed electrode pattern Gp2 has the via hole electrodes punched thereon, and the via hole electrodes are connected to the under surface ground electrode patterns TG respectively. The earthed electrode pattern Gp2 is connected to the earthed electrode pattern Gp1 formed on the top surface of the dielectric layer L2 via the plurality of via hole electrodes.

The RF signal under surface electrode patterns TR are connected to the stripline electrode patterns Lp2, Lp4, Lp9, Lp11, Lp13, Lp15 and Lp17 formed on the top surface of the dielectric layer L1 via the wiring electrode patterns formed on the dielectric layers constituting the via hole electrodes and the dielectric layered body 31 respectively. And the control signal under surface electrode patterns TS are connected to the stripline electrode patterns Lp5 to Lp8 formed on the top surface of the dielectric layer L1 via the via hole electrodes and the wiring electrode patterns formed on the dielectric layers constituting the dielectric layered body 31 respectively.

Figure 7:
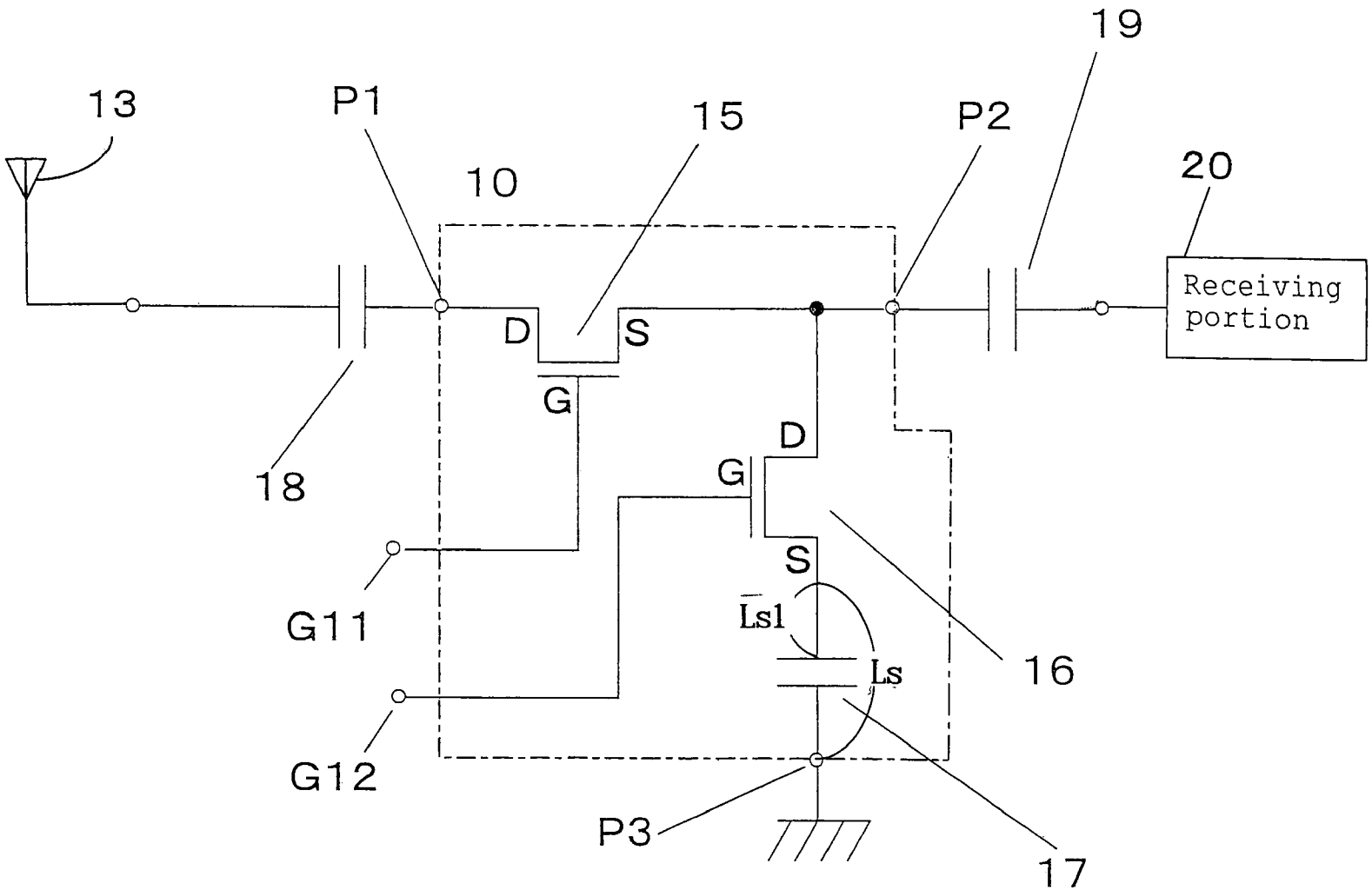
FIG. 7 is an equivalent circuit diagram of an SPST switch which is the basics of the antenna switch module according to the first embodiment of the present invention.

A circuit of the portion enclosed by the dashed line in FIG. 7 is an equivalent circuit of an SPST (Single-Pole Single- Throw) switch 10 which is the most basic switch circuit in constituting the antenna switch module 30 of the first embodiment. The configuration and operation of the basic antenna switch circuit will be described by referring to FIG. 7 and taking as an example the case where an electronics device such as a portable telephone receives a signal from the antenna.

An SPST switch circuit is comprised of the SPST switch 10, a second DC cut capacitor 18 and a third DC cut capacitor 19 both of which are connected to the outside of the SPST switch 10. And a first high-frequency signal input-output terminal P1 of the SPST switch 10 is connected to an antenna 13 via the second DC cut capacitor 18, a second high-frequency signal input-output terminal P2 is connected to a receiving portion 20 via the third DC cut capacitor 19, and a third high-frequency signal input-output terminal P3 is connected to the ground.

In the SPST switch 10, the first high-frequency signal input-output terminal P1 is connected to a drain terminal of a first FET 15, and a source terminal of the first FET 15 is connected to the second high-frequency signal input-output terminal P2. The source terminal of the first FET 15 is connected to the drain terminal of a second FET 16, and the source terminal of the second FET 16 is connected to the third high-frequency signal input-output terminal P3 via the first DC cut capacitor 17. Here, the second FET 16 and first DC cut capacitor 17, and the second high-frequency signal input-output terminal P2, third high-frequency signal input-output terminal P3 and a gate terminal G12 connected thereto form the shunt circuit of the SPST switch 10.

The operation of the SPST switch 10 constituted as above will be described below.

Bias voltages of $+V_G$ [V], 0 [V] to the ground are applied to a gate terminal G11 of the first FET 15 and a gate terminal G12 of the second FET 16 respectively. In this case, a potential to the ground at the source terminal of the first FET 15 (hereafter, referred to as $V_{S1}$) and the potential to the ground at the drain terminal of the second FET 16 (hereafter, referred to as $V_{D2}$) are the same so that a potential relationship of these terminals is as in a formula 1. Here, $V_{G1}$ and $V_{G2}$ are the potentials to the ground at the gate terminals of the first FET 15 and second FET 16 respectively.

$$+V_G=V_{G1}>V_{S1}=V_{D2}>V_{G2}=0[V] \quad \text{(Formula 1)}$$

When the first FET 15 is seen on such a bias condition, it is a forward bias between the gate and source terminals. And when the second FET 16 is seen, it is a backward bias between the drain and gate terminals. As the third DC cut capacitor 19 is connected to the second high-frequency signal input-output terminal P2, it is considered that a forward current and a backward current thereof are the same, and the relationship between a potential difference $V_{G1}-V_{S1}$ between the gate and source terminals of the first FET 15 and the potential difference $V_{D2}-V_{G2}$ between the drain and gate terminals of the second FET 16 is as in a formula 2.

$$V_{G1}-V_{S1}<<V_{D2}-V_{G2} \quad \text{(Formula 2)}$$

As it is the backward bias between the drain and gate terminals of the second FET 16, the running current is very little. Therefore, the potential $V_{S1}$ of the source terminal of the first FET 15 and the potential $V_{D2}$ of the drain terminal of the second FET 16 are as in a formula 3, and so they are in the relationship in a formula 4.

$$V_{S1}=V_{D2} \quad \text{(Formula 3)}$$

$$V_{D2}\approx V_G \quad \text{(Formula 4)}$$

Consequently, the first FET 15 is in an on state and the second FET 16 is in an off state so that the signals inputted from the antenna 13 are outputted to the receiving portion 20.

Likewise, in the case of applying the bias voltages of 0 [V], $+V_G$ [V] to the gate terminal G11 of the first FET 15 and the gate terminal G12 of the second FET 16 respectively, the first FET 15 is put in the off state and the second FET 16 is put in the on state. Therefore, the signals inputted from the antenna 13 are mostly attenuated at the first FET 15, and the few signals passing through it flow to the ground via the second FET 16 so that there is no signal flowing from the antenna 13 to the receiving portion 20.

Therefore, it is possible, as described above, to control the potential $V_{G1}$ of the gate terminal G11 of the first FET 15 and the potential $V_{G2}$ of the gate terminal G12 of the second FET 16 so as to have the SPST switch 10 function as the antenna switch.

In the case where a high-voltage signal such as an electrostatic surge flows in from the outside via the antenna 13 and so on, the first DC cut capacitor 17 of the SPST switch 10 plays a role of a surge-absorbing capacitor so as to protect the SPST switch 10.

The above configuration and operation of the antenna switch circuit were described by taking as an example the case where the electronics device receives the signals from the antenna. However, the configuration and operation of the antenna switch circuit are the same as to the electronics device for transmitting the signals from the antenna. In the case of transmitting the signals from the antenna, the second high-frequency signal input-output terminal P2 is connected to a transmitting portion instead of the receiving portion 20 via the third DC cut capacitor 19 in FIG. 7. It may also be a duplicate configuration for receiving inputs and outputs from both the transmitting portion and the receiving portion.

Figure 8:
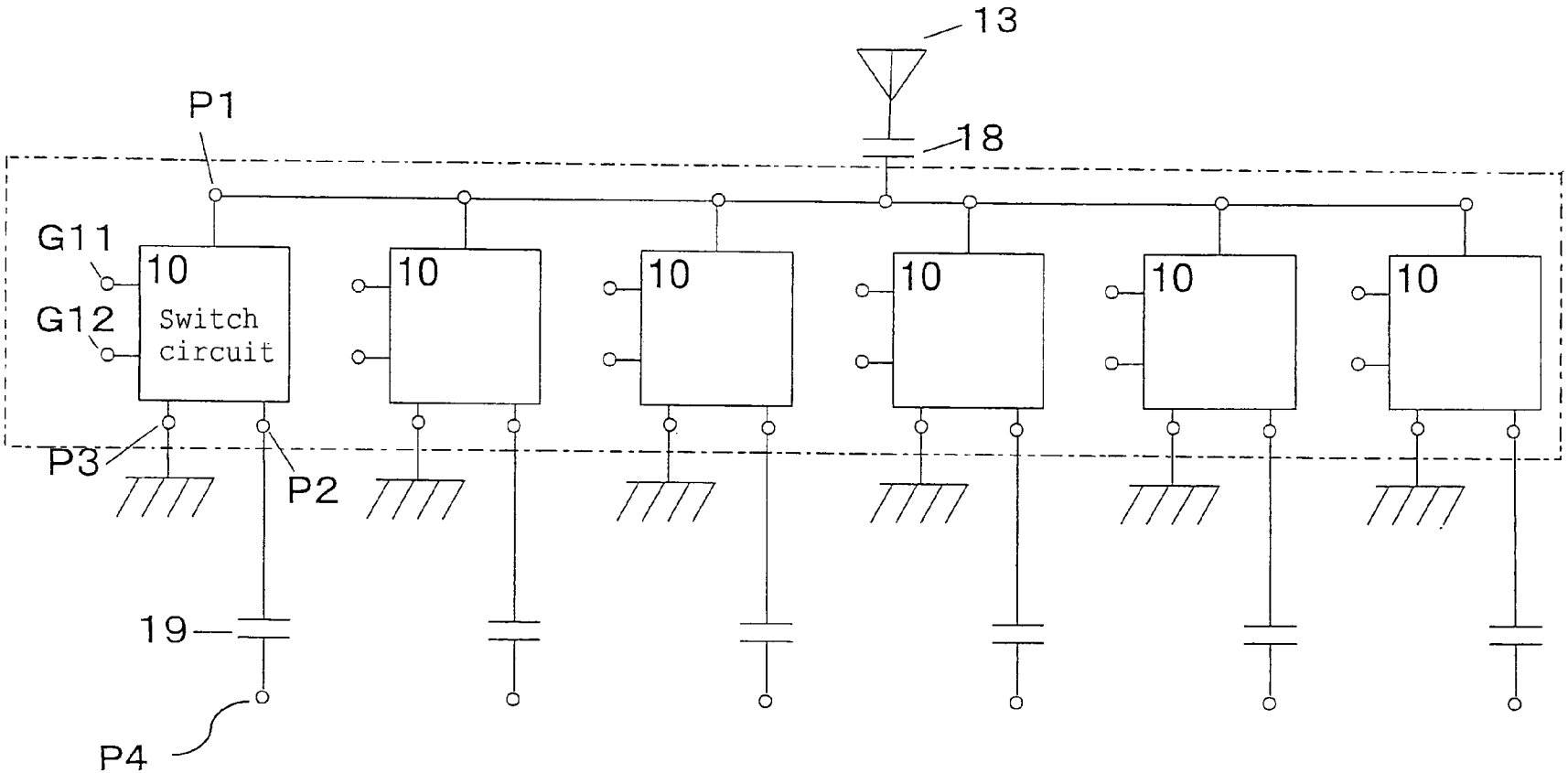
FIG. 8 is an equivalent circuit diagram of the antenna switch module according to the first embodiment of the present invention.

The antenna switch module 30 according to the first embodiment is the portion enclosed by the dashed line in FIG. 8, which is a circuit configuration wherein six SPST switches 10 are connected in parallel while having the first high-frequency signal input-output terminals P1 in common. The DC cut capacitor 17 constituting the shunt circuit in FIG. 7 of each SPST switch 10 is formed in the dielectric layered body 31.

And all the remaining elements of each SPST switch 10, that is all the circuit portions such as the first FET 15 and second FET 16 except the DC cut capacitor 17 are provided to the switch semiconductor chip 32 and logic semiconductor chip 33. And terminals P4 after the second high-frequency signal input-output terminals P2 go through the third DC cut capacitors 19 are connected to different receiving portion or transmitting portion respectively.

It is possible, as to each route, to control a bias potential to be applied to the gate terminal G11 of the first FET 15 and the gate terminal G12 of the second FET 16 of the SPST switch 10 so as to switch the route to the receiving portion or transmitting portion to be connected to the antenna 13 and have the antenna switch module 30 according to the first embodiment function as an SP6T antenna switch module.

The capacitors C1 to C6 formed inside the dielectric layered body 31 function as the first DC cut capacitor 17 constituting the shunt circuit of the antenna switch module 30 according to the first embodiment.

Dielectric film thickness of the capacitors C1 to C6 formed inside the dielectric layered body 31 is 12.5 $\mu$m or so, which is thicker than the film thickness of 0.3 $\mu$m or so of the capacitors formed inside the semiconductor chip manufactured by using a GaAs material of the past. Therefore, there is an experimental result that electrostatic surge withstand pressure improves by two to three times in comparison with the antenna switch module in the prior art. In this case, the electrostatic surge withstand pressure in the antenna switch module 30 according to the first embodiment is determined by the withstand pressure of the FETs instead of the withstand pressure of the capacitors.

According to this embodiment, the FETs of the SPST switch are electrically connected to the capacitors by using the via hole electrodes and utilizing a thickness direction of the dielectric layered body. As a result of having such a configuration, a wiring Ls1 shown in FIG. 7 becomes slightly longer than the ones using an MIM capacitor in the prior art. However, the wirings of the stripline electrode patterns Lp1 to Lp17 and thereafter can be sufficiently shorter than the case of routing them on the top surface of the dielectric layered body 31 as in the prior art. For that reason, it is possible to curb a parasitic inductance component between the FETs and the ground and realize reduction in the impedance so as to sufficiently maintain a high-frequency characteristic.

The antenna switch module 30 according to the first embodiment has the earthed electrode pattern Gp1 of large area formed on the dielectric layer L2 which is the second electrode layer from the top of the dielectric layered body 31. And the first DC cut capacitor 17 is formed by including the earthed electrode pattern Gp1 of the large area inside the dielectric layered body 31.

Furthermore, an SPnT (n: an arbitrary natural number) switch such as the SPST switch of this embodiment requires n pieces of the capacitors to be used for the shunt circuit. However, it is possible, by taking the above configuration, to sandwich the capacitors with two ground electrodes of the earthed electrode patterns Gp1 and Gp2 so as to render electrode area small. To be more specific, in the dielectric layered body 31, the first dielectric layer L1 is set to have a thicker film thickness than other layers in order to keep its strength. Therefore, it is more advantageous, for the sake of rendering the area small, to form capacitor electrodes between the ground electrodes of the first dielectric layer L1 and the third dielectric layer L3 rather than to form the capacitors with the ground electrodes, land electrode pattern for dies bond Dp1 and so on.

Furthermore, the dies bond electrode must have wire-bonded electrodes placed around it, and so it is limited area-wise by the ground electrode of the first dielectric layer L1.

Therefore, it is easier, by forming the capacitors with the ground electrode of the first dielectric layer L1, to form a large number of capacitors of large area and obtain a necessary capacity.

Furthermore, the earthed electrode pattern Gp1 is connected to a plurality of under surface ground electrode patterns TG by a plurality of via hole electrodes so that it is possible to curb the parasitic inductance component between the second FET 16 of a FET switch and the ground. Therefore, it is possible to realize the reduction in the impedance between the second FET 16 of the FET switch and the ground on a switch operation, and the antenna switch module 30 according to the first embodiment can improve the high-frequency characteristic.

The stripline electrode patterns on the dielectric layer L1 are connected to the electrode patterns such as the capacitor electrode patterns Cp1 to Cp6 on the dielectric layer L3 via the via hole electrodes provided to the spacer patterns Sp1 to Sp7 formed inside the earthed electrode pattern Gp1. Thus, it is possible to render line length shorter than the case of connecting via the via hole electrodes provided outside the earthed electrode patterns in the prior art so as to reduce the impedance. To be more specific, this configuration also has an effect of reducing the impedance between the second FET 16 of the FET switch and the ground on the switch operation, and so the antenna switch module 30 according to the first embodiment can further improve the high-frequency characteristic.

Thus, as for the antenna switch module according to the first embodiment, the capacitors are not destroyed even in the case where the high-voltage signal such as the electrostatic surge flows in, and it can present the ground potential of the FET of the shunt circuit from rising on the switch operation. Therefore, it is possible to provide the antenna switch module excellent in the high-frequency characteristic.

The switch semiconductor chip 32 and logic semiconductor chip 33 are dies-bond-mounted on the top surface of the dielectric layered body and have the earthed electrode pattern Gp1 which is larger than the land electrode pattern for dies bond Dp1. Therefore, the ground potentials of the switch semiconductor chip 32 and logic semiconductor chip 33 become stable. For this reason, it is possible to provide the antenna switch module of a stable switch operation.

Figure 14:
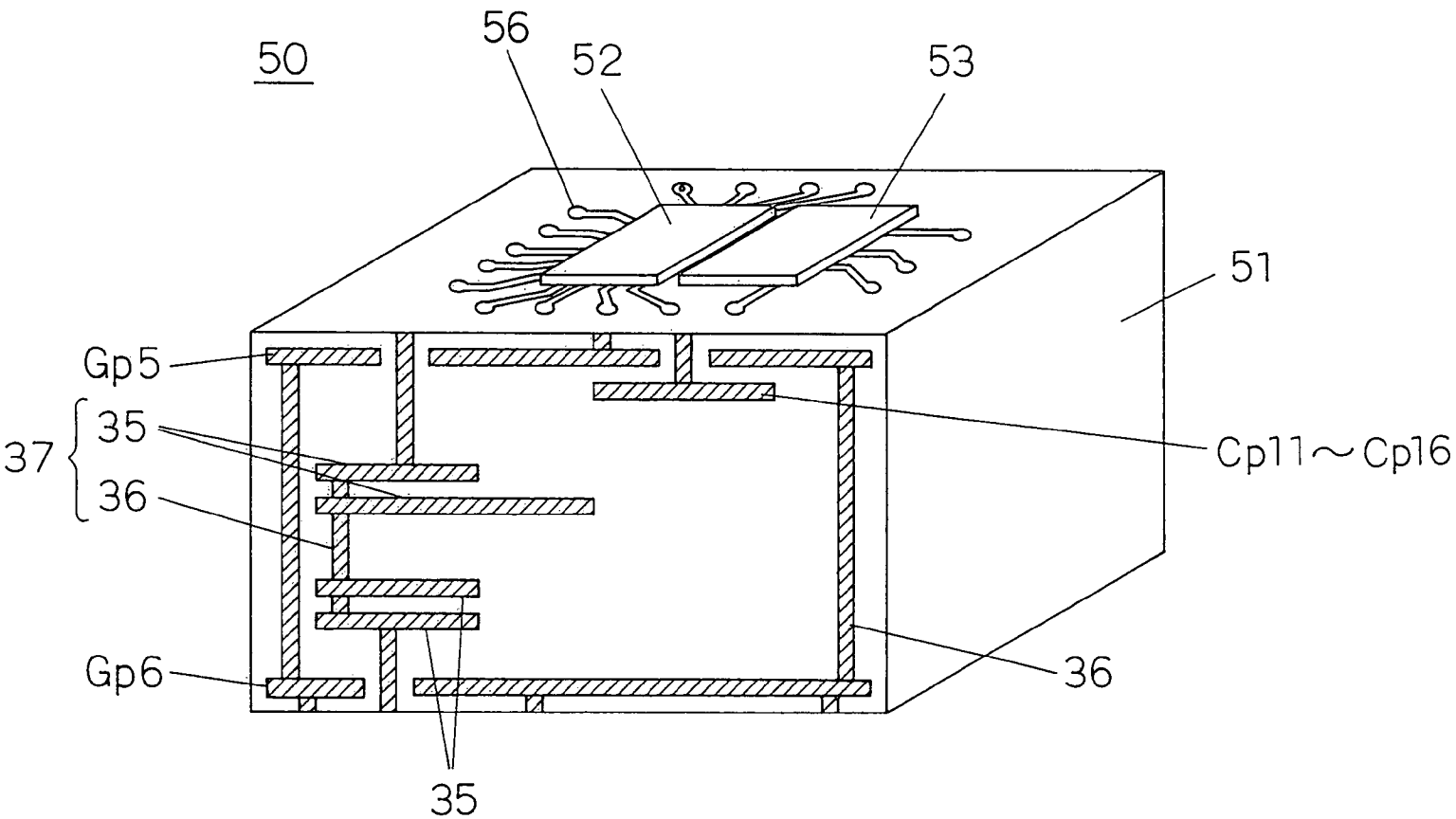
FIG. 14 is a perspective view of another configuration example of the antenna switch module according to the second embodiment of the present invention.

As for the FET switch of the past including the first DC cut capacitor 17 inside a semiconductor chip 46 in FIG. 14, a size of the MIM capacitor for functioning as the first DC cut capacitor 17 is 100 $\mu$m square or so. In the case of using the antenna switch module 30 according to the first embodiment, it is possible to eliminate the MIM capacitor from the inside of the semiconductor chip of the past so as to reduce the semiconductor chip size. The switch semiconductor chip in which the MIM capacitor was placed in the prior art uses expensive semiconductors such as GaAs, and so the number of the semiconductor chips producible from one wafer can be increased by reducing the chip size so as to allow reduction in semiconductor chip costs.

According to the first embodiment, the dielectric material of an A1-Mg—Si—Gd—O system is used as the material of the dielectric layered body. However, it is possible to obtain the same effect by using another dielectric material of a higher dielectric constant. In this case, it is possible to reduce the area occupied by the capacitors placed inside dielectric layered body so as to realize miniaturization of the antenna switch module.

The same effect can also be obtained in the case where the drain terminal and source terminal of the first FET 15 and the second FET 16 are connected contrary to the first embodiment.

According to the first embodiment, the dielectric layered body 31 is formed by five layers of the dielectric layers L1 to L5. However, the number of the dielectric layers forming the dielectric layered body is not limited, and so it may be either more or less than the five layers.

(Second Embodiment)

The antenna switch module according to a second embodiment will be described by referring to the drawings.

Figure 9:
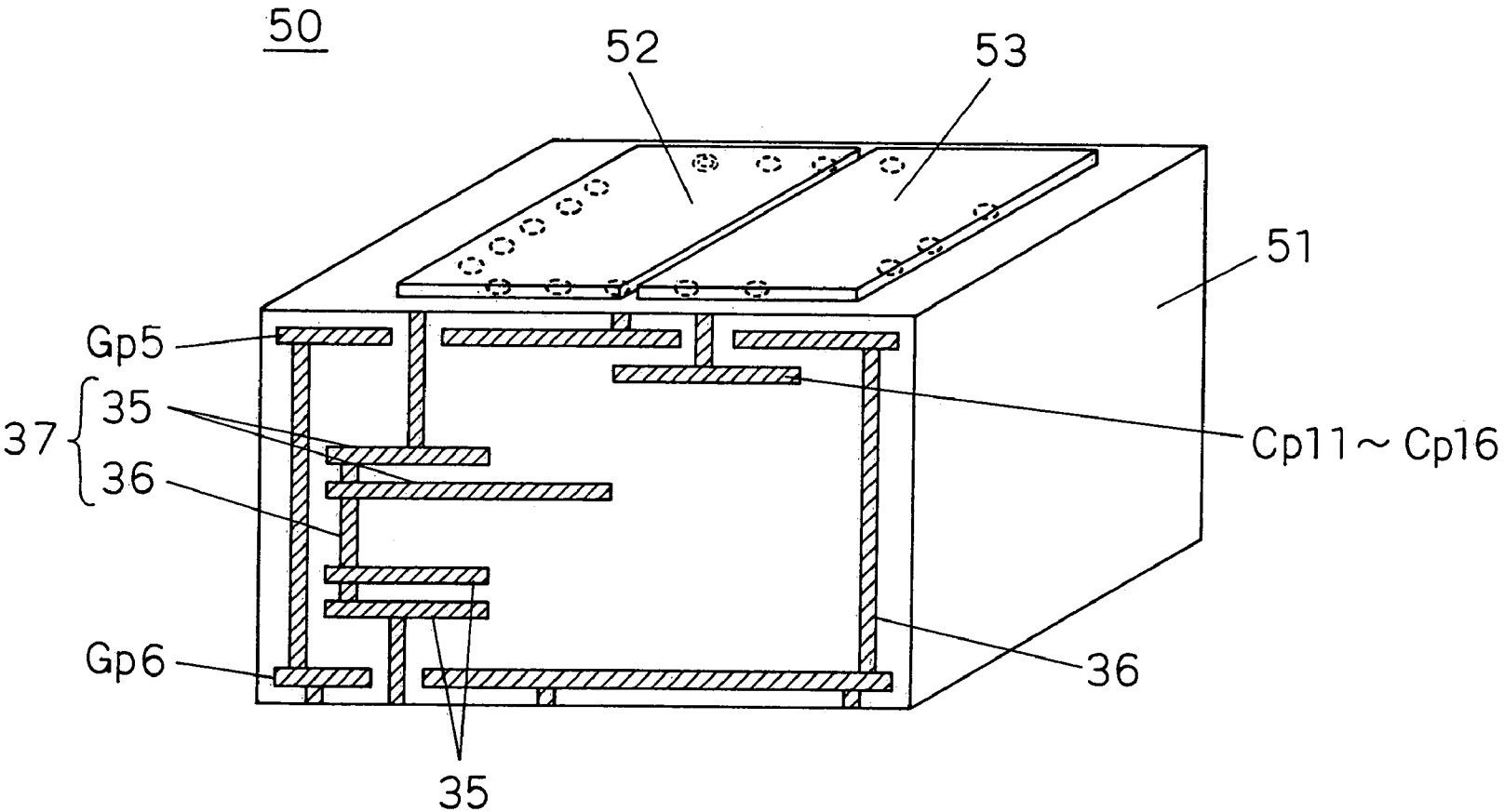
FIG. 9 is a perspective view of the antenna switch module according to the second embodiment of the present invention.

FIG. 9 is a perspective view of an antenna switch module 50 according to the second embodiment, and it partially shows a sectional view. The antenna switch module 50 according to the second embodiment is produced just like the antenna switch module 30 according to the first embodiment. A dielectric layered body 51 is comprised of a plurality of dielectric layers as the dielectric sheets of the present invention as with the dielectric layered body 31 of the first embodiment.

The dielectric layered body 51 has a high-frequency filter 37 formed by an internal electrode pattern 35 and a via hole electrode 36 formed by printing the high-frequency filter 37 being placed, below an earthed electrode pattern Gp5 and capacitor electrode patterns Cp11 to Cp16. The high-frequency filter 37 referred to here is a low-pass filter connected between the antenna switch and the transmitting portion, for instance. Capacitors C11 to C16 to be connected to a shunt of an FET switch circuit are implemented by the earthed electrode pattern Gp5 and capacitor electrode patterns Cp11 to Cp16.

And a switch semiconductor chip 52 and a logic semiconductor chip 53 having an FET switch function are mounted face down on the top surface of the dielectric layered body 51. In this case, the switch semiconductor chip 52 and logic semiconductor chip 53 are electrically connected to the dielectric layered body 51 by flip chip mounting using a bump inside the surface of each semiconductor chip if projectively viewed from the top surface of the dielectric layered body 51.

Figure 10:
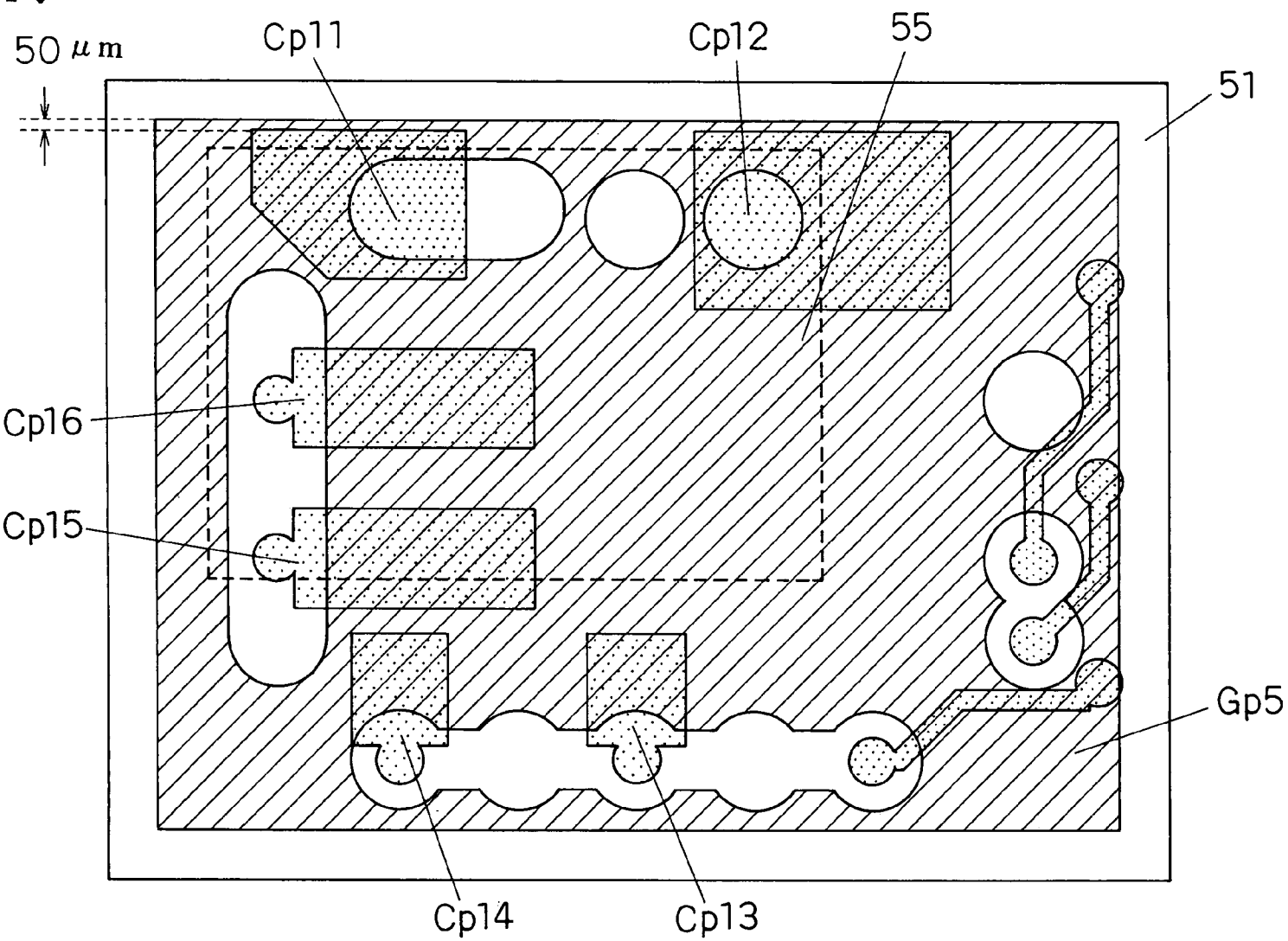
FIG. 10 is a top perspective view of the antenna switch module according to the second embodiment of the present invention.
Figure 11:
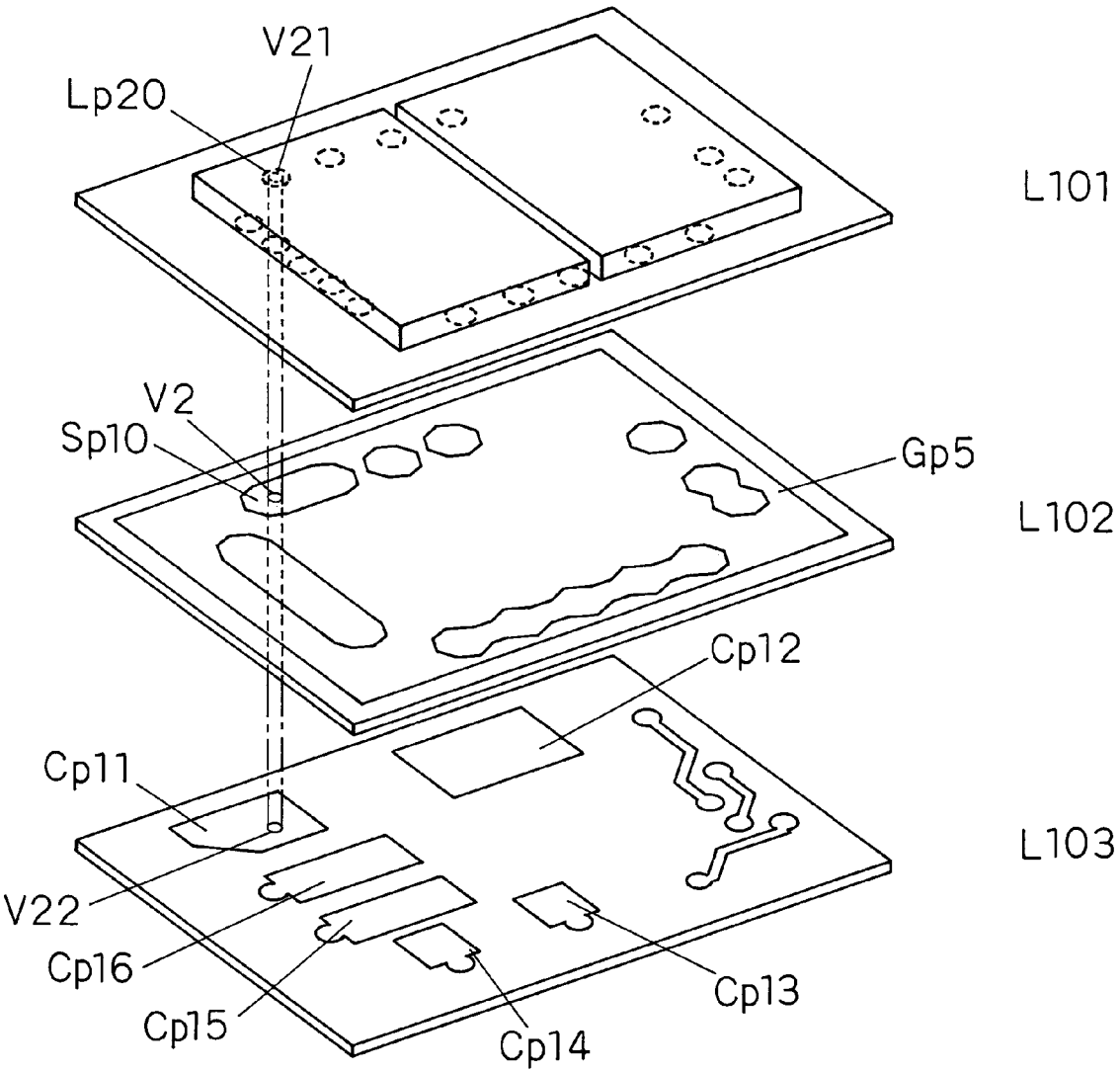
FIG. 11 is a diagram showing the dielectric layers L101 to L103 of the antenna switch module according to the second embodiment of the present invention.

FIG. 10 is a top perspective view showing only the electrode patterns of a dielectric layer L102 as the second electrode layer from the top and a dielectric layer L103 as the third electrode layer from the top shown in FIG. 11 of the dielectric layered body 51 constituting the antenna switch module 50 according to the second embodiment. A shaded area in FIG. 10 indicates the electrode pattern formed in the dielectric layer L102, and dotted areas indicate the electrode patterns formed in the dielectric layer L103. The high-frequency filter 37 is formed by combining the dielectric layers lower than the dielectric layer L103. And the range in which the electrode patterns forming the high-frequency filter 37 are placed is indicated as a high-frequency filter area 55 by enclosing it with dushed lines.

The earthed electrode pattern Gp5 of the dielectric layer L102 is formed by printing. And the electrode patterns such as inductor electrodes, capacitor electrodes and stripline electrodes formed by combining the electrode patterns of the dielectric layers lower than the dielectric layer L103 constitute the high-frequency filter 37. The area of the earthed electrode pattern Gp5 is large enough to cover the high-frequency filter area 55 in which the electrode patterns for constituting the high-frequency filter are formed.

FIG. 11 is an exploded perspective view showing the dielectric layers L101 to L103 which are the three layers from the topmost layer of the plurality of dielectric layers constituting the dielectric layered body 51. The dielectric layered body 51 is formed by these three dielectric layers and a plurality of dielectric layers lower than the dielectric layer L103.

The spacer patterns for punching the via hole electrodes not shorting the earthed electrode pattern Gp5 are formed in the electrode surface of the earthed electrode pattern Gp5 formed on the dielectric layer L102. The dielectric layer L101 has the electrode patterns for mounting the switch semiconductor chip 52 and logic semiconductor chip 53 and the stripline electrode patterns comprising via land electrodes formed on the top surface thereof.

The stripline electrode patterns are connected to the capacitor electrode patterns Cp11 to Cp16 formed on the dielectric layer L103 and the internal electrode pattern 35 for forming the high-frequency filter 37 and so on placed in the dielectric layer L103 or in the dielectric layer lower than that or the under surface electrode patterns formed on the under surface of the dielectric layered body 51. And the via hole electrodes for connecting the stripline electrode patterns formed on the dielectric layer L101 to the electrode patterns formed in the layers lower than the dielectric layer L102 are punched on the spacer patterns formed in the electrode surface of the earthed electrode pattern Gp5 on the dielectric layer L102.

A description will be given by using FIG. 11 as to the connection between the stripline electrode pattern Lp20 and the capacitor electrode pattern Cp11 for instance. The stripline electrode pattern Lp20 includes a via land electrode pattern V21 with the 125 $\mu$m radius, and the capacitor electrode pattern Cp11 includes a via land electrode pattern V22 with the 125 $\mu$m radius. And the spacer pattern Sp10 formed on the earthed electrode pattern Gp5 has a via hole electrode pattern V2 with a 150 $\mu$m via radius punched thereon. The via land electrode pattern V21 is connected to the via land electrode pattern V22 via the via hole electrode pattern V2 so that the stripline electrode pattern Lp20 is connected to the capacitor electrode pattern Cp11.

The spacer pattern Sp10 has a shape of the string of the circular spacer patterns with the 300 $\mu$m radius centering on the via land electrode pattern. The capacitor electrode pattern Cp11 is placed opposite the earthed electrode pattern Gp5 except the area projectively overlapping the spacer pattern Sp10. Thus, a capacitor C11 is formed by the capacitor electrode pattern Cp11 and the earthed electrode pattern Gp5. Likewise, capacitors C12 to C16 are formed by the capacitor electrode patterns Cp12 to Cp16 and the opposite earthed electrode pattern Gp5 respectively.

Figure 12:
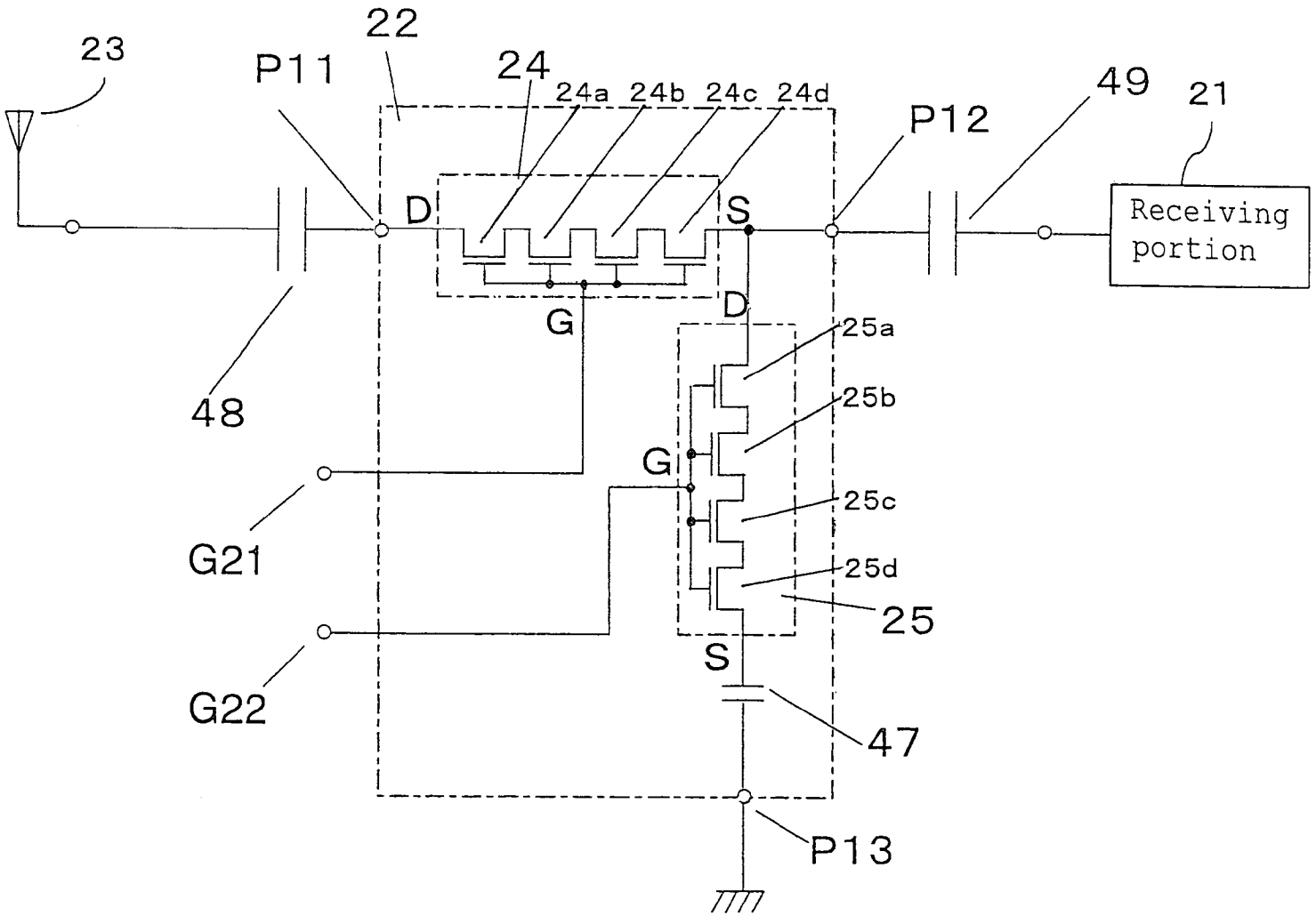
FIG. 12 is an equivalent circuit diagram of the SPST switch which is the basics of the antenna switch module according to the second embodiment of the present invention.

The circuit of the portion enclosed by an alternate long and short dashed line in FIG. 12 is the equivalent circuit of an SPST switch 22 which is the most basic switch circuit in constituting the antenna switch module of the second embodiment. A description will be given by referring to FIG. 12 as to the configuration of the basic antenna switch circuit for receiving a signal from an antenna, which is used for the electronics device such as the portable telephone.

An SPST switch circuit is comprised of the SPST switch 22, and a second DC cut capacitor 48 and a third DC cut capacitor 49 both of which are connected to the outside of the SPST switch 22. And a first high-frequency signal input-output terminal P11 of the SPST switch 22 is connected to an antenna 23 via the second DC cut capacitor 48, a second high-frequency signal input-output terminal P12 is connected to a receiving portion 21 via the third DC cut capacitor 49, and a third high-frequency signal input-output terminal P13 is connected to the ground. The SPST switch 22 is comprised of a first FET group 24 consisting of FETs 24*a*, 24*b*, 24*c* and 24*d* connected in parallel in four stages, a second FET group 25 consisting of FET 25*a*, 25*b*, 25*c* and 25*d* connected in parallel in four stages likewise and a first DC cut capacitor 47.

The first high-frequency signal input-output terminal P11 is connected to the drain terminal of a FET 24*a* on the first stage of the first FET group 24, and the source terminal of the FET 24*a* on the first stage of the first FET group is connected to the drain terminal of the second FET 24*b* on the second stage of the first FET group 24. The source terminal of the FET 24*b* on the second stage of the first FET group 24 is connected to the drain terminal of the FET 24*c* on the third stage of the first FET group 24, and the source terminal of the FET 24*c* on the third stage of the first FET group 24 is connected to the drain terminal of the FET 24*d* on the fourth stage of the first FET group 24. And the source terminal of the FET 24*d* on the fourth stage of the first FET group 24 is connected to the second high-frequency signal input-output terminal P12. The source terminal of the FET 24*d* on the forth stage of the first FET group 24 is connected to the drain terminal of the FET 25*a* on the first stage of the second FET group 25. The second FET group 25 is connected in parallel as with the first FET group 24, and the source terminal of the FET 25*d* on the fourth stage of the second FET group 25 is connected to the third high-frequency signal input-output terminal P13 via the first DC cut capacitor 47.

The operation of the SPST switch 22 constituted as above will be described below.

The gate terminals of the FETs 24*a*, 24*b*, 24*c* and 24*d* forming the first FET group 24 are mutually connected, and the gate terminals of the FETs 25*a*, 25*b*, 25*c* and 25*d* forming the second FET group 25 are also mutually connected likewise. To be more specific, the same bias voltage is applied to all the gate terminals of the FETs 24*a*, 24*b*, 24*c* and 24*d* forming the first FET group 24, and likewise, the same bias voltage is applied to all the gate terminals of the FETs 25*a*, 25*b*, 25*c* and 25*d* forming the second FET group 25. Therefore, it is possible to consider the operation of the antenna switch module of the second embodiment as the one in which the first FET 15 and the second FET 16 of the first embodiment shown in FIG. 7 are replaced by the first FET group 24 and the second FET group 25 of the antenna switch module of the second embodiment.

In the case of applying the bias voltages of $+V_G$ [V] 0 [V] to a gate terminal G21 of the first FET group 24 and a gate terminal G22 of the second FET group 25 respectively, the first FET group 24 is put in the on state and the second FET group 25 is put in the off state. Therefore, the signals inputted from the antenna 23 are outputted to the receiving portion 21.

Inversely, in the case of applying the bias voltages of 0 [V], $+V_G$ [V] to the gate terminal G21 of the first FET group 24 and the gate terminal G22 of the second FET group 25 respectively, the first FET group 24 is put in the off state and the second FET group 25 is put in the on state. Therefore, the signals inputted from the antenna 23 are mostly attenuated in the first FET group 24, and the few signals passing through it flow to the ground via the second FET group 25 so that there is no signal flowing from the antenna 23 to the receiving portion 21.

In the case where the high-voltage signal such as the electrostatic surge flows in from the outside via the antenna 23, the first DC cut capacitor 47 plays a role of the surge-absorbing capacitor so as to protect the SPST switch 22.

The above configuration and operation of the antenna switch circuit were described by taking as an example the case where the electronics device receives the signals from the antenna. However, the configuration and operation of the antenna switch circuit are the same as to the electronics device for transmitting the signals from the antenna. In the case of transmitting the signals from the antenna, the second high-frequency signal input-output terminal P12 is connected to the transmitting portion instead of the receiving portion 21 via the third DC cut capacitor 49 in FIG. 12.

Figure 13:
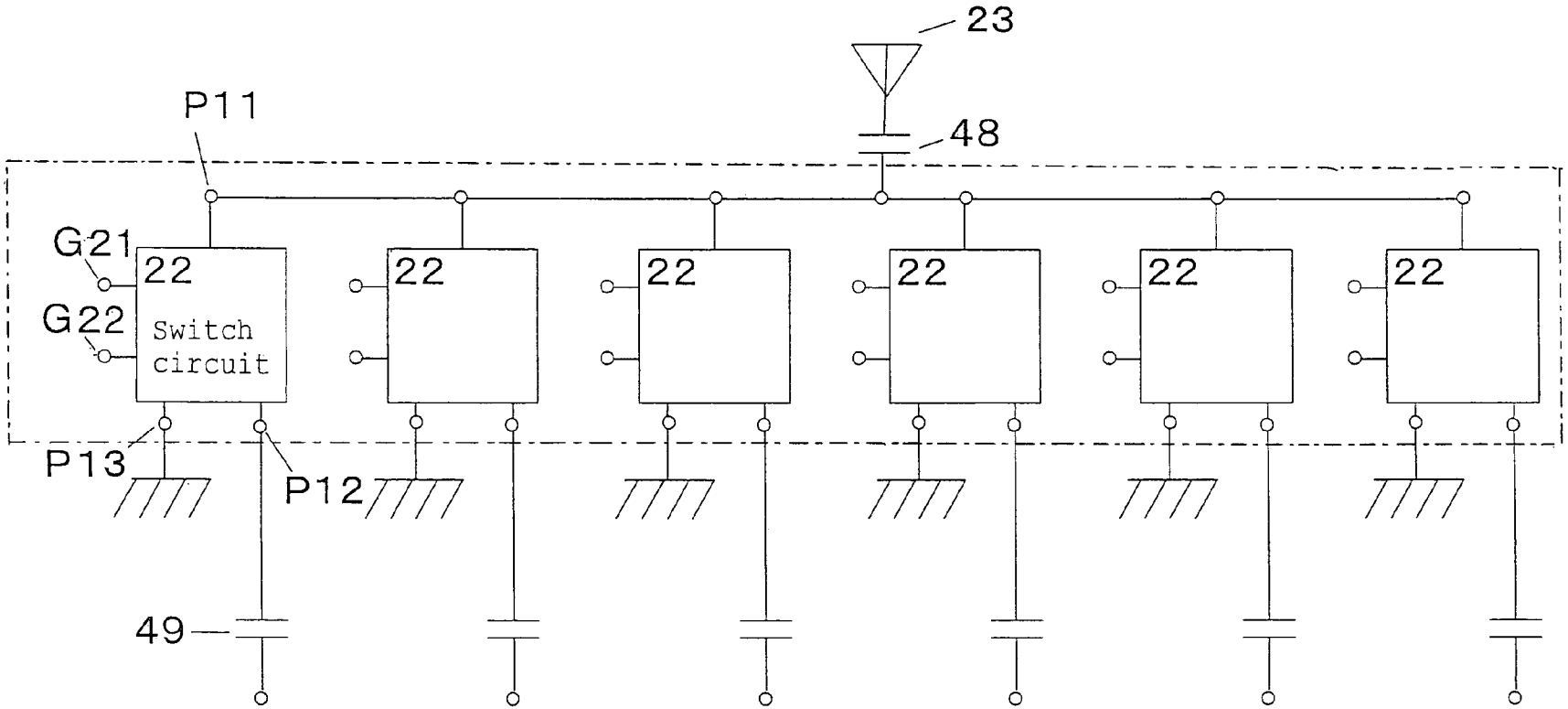
FIG. 13 is an equivalent circuit diagram of the antenna switch module according to the second embodiment of the present invention.

The antenna switch module 50 according to the second embodiment is the antenna switch module wherein six SPST switches 22 shown in FIG. 12 are connected in parallel while having the first high-frequency signal input-output terminals P11 in common, which is the portion enclosed by the dashed line in FIG. 13. It is possible to control the bias potential to be applied to the gate terminals G21 and G22 of the FET groups so as to switch the route to the receiving portion or transmitting portion to be connected to the antenna 23 and have the antenna switch module 50 according to the second embodiment function as the SP6T antenna switch module.

The capacitors C11 to C16 formed inside the dielectric layered body 51 function as the first DC cut capacitor 47 of the antenna switch module 50 according to the second embodiment. As with the antenna switch module 30 according to the first embodiment, it is possible, by using the capacitors C11 to C16 formed inside the dielectric layered body 51 as the first DC cut capacitor 47, to improve the electrostatic surge withstand pressure of the antenna switch module 50 according to the second embodiment by two to three times in comparison with the antenna switch module in the prior art.

As shown in FIG. 9, the antenna switch module 50 according to the second embodiment has the switch semiconductor chip 52 and a logic semiconductor chip 53 mounted face down on the top surface of the dielectric layered body 51. And it is possible, compared to the first embodiment, to further shorten by flip chip mounting using the bump the distance between the second FET group 25 and the capacitors C11 to C16 forming the first DC cut capacitor 47, that is, the wiring Ls1 shown in FIG. 7 inside the surface of each semiconductor chip. As shown in FIG. 11, the dielectric layer L102 which is the second electrode layer from the top of the dielectric layered body 51 has the earthed electrode pattern Gp5 which is large enough compared to the area of the dielectric layer L102. And the capacitor electrode patterns Cp11 to Cp16 are formed on the layer lower than the dielectric layer L102, and are connected to the FET of the shunt of the switch semiconductor chip 52 via the via hole electrodes punched on the spacer pattern inside the electrode surface of the earthed electrode pattern Gp5 so as to form the first DC cut capacitor 47 between it and the earthed electrode pattern Gp5. Furthermore, the earthed electrode pattern Gp5 is connected to the electrode patterns on the under surface of the dielectric layered body 51 via a plurality of via hole electrodes.

Therefore, it is possible to curb the parasitic inductance component in the line length connecting the second FET group 25 of the FET switch to the ground so as to reduce the impedance between the second FET group 25 of the FET switch and the ground on the switch operation and realize the improvement in the high-frequency characteristic.

Thus, according to the antenna switch module 50 of the second embodiment, it is possible to provide the antenna switch module excellent in the high-frequency characteristic, wherein the capacitors are not destroyed even in the case where the high-voltage signal such as the electrostatic surge flows in, and it functions as the switch and further keeps the ground potential of the FET of the shunt from rising on the switch operation.

As shown in FIG. 10, the capacitor electrode pattern Cp12 formed on the top surface of the dielectric layer L103 is placed to cover all the spacer patterns formed on the earthed electrode pattern Gp5. Therefore, a capacitance value of the capacitor C12 of the shunt formed here is not influenced at all by a lamination drift arising on production of the dielectric layered body 51 so that it is possible to provide the capacitor of the shunt having a desired capacitance value. Likewise, as for the other capacitor electrode patterns formed on the top surface of the dielectric layer L103, it is possible to provide the capacitor of the shunt having the desired capacitance value by placing them to cover all the spacer patterns formed on the earthed electrode pattern Gp5.

Furthermore, in order to prevent the capacitor electrode patterns Cp11 to Cp16 from extending off the area covered by the earthed electrode pattern Gp5 due to the lamination drift, the capacitor electrode patterns Cp11 to Cp16 are placed 50 μm or so inside from a surface position of the earthed electrode pattern Gp5 as shown in FIG. 10.

It is also possible to shield electromagnetic waves generated by the switch semiconductor chip 52 and the high-frequency filter 37 with the earthed electrode pattern Gp5 so as to obtain a desired high-frequency characteristic from the switch semiconductor chip 52 and the high-frequency filter 37.

As the high-frequency filter 37 is formed by combining the dielectric layers lower than the earthed electrode pattern Gp5 while sandwiching the capacitor electrode patterns Cp11 to Cp16, it is also possible to reduce a stray capacitance generated between the earthed electrode pattern Gp5 and the high-frequency filter 37, in particular, the stripline electrode pattern for implementing the inductor. Therefore, the high-frequency filter 37 allows improvement in the high-frequency characteristic.

As the stripline electrode patterns on the dielectric layer L101 are connected to the electrode patterns on the dielectric layer L103 and lower layers via the via hole electrodes provided to the spacer patterns formed inside the earthed electrode pattern Gp5, it is possible to shorten the line length of the stripline electrodes on the top surface of the dielectric layer L101. If the line length of the stripline electrodes on the top surface of the dielectric layer L101 is shortened, it is possible to reduce the impedance between the FET of the shunt of the FET switch circuit and the ground in conjunction therewith so as to further improve the high-frequency characteristic.

According to the second embodiment, it is possible to obtain the same effect even if the high-frequency filter 37 formed in the dielectric layered body 51 is not the low-pass filter but the high-pass filter.

According to the second embodiment, it is possible to obtain the same effect, without being influenced by any other circuit configuration such as a resistance connected to the gate terminal, in the case of the circuit configuration wherein the FET switch has the FET in the shunt and the capacitor between the FET and the ground.

According to the second embodiment, one FET group is the FET switch comprised of the FETs connected in parallel in four stages. However, the FETs constituting one FET group is not limited to the four stages, but it is possible to obtain the same effect no matter how many stages the FETs constituting one FET group are in.

It is also possible to obtain the same effect even if the drain and source terminals of the FETs of the first FET group 24 and the second FET group 25 are connected inversely with the second embodiment respectively.

Both the embodiments defined that the antenna switch module has the configuration of the SP6T switch. However, it is possible to obtain the same effect even in the case of other configurations such as the SPST, SPDT, SP4T and SP7T.

According to the second embodiment, the electrical connections among the switch semiconductor chip 52, logic semiconductor chip 53 and dielectric layered body 51 are made inside the surface of each semiconductor chip if projectively viewed from the top surface of the dielectric layered body 51. However, it is also possible, as shown in FIG. 14, to provide a printed wiring pattern 56 extending off the surface of each semiconductor chip so as to electrically connect the bumps and via holes to both ends of the printed wiring pattern. In this case, the wiring Ls1 shown in FIG. 7 becomes longer than the example shown in FIG. 9, but a degree of freedom of circuit design can be enhanced. It is also possible, as required, to mix the ones electrically connected to the dielectric layered body 51 inside the surface of each semiconductor chip and the ones electrical connected to the dielectric layered body 51 by extending off the surface.

The switch semiconductor chip for constituting the antenna switch module is not limited to the semiconductor chip using GaAs. And the logic semiconductor chip for controlling the operation of the switch semiconductor chip is not limited to the semiconductor chip using Si. It is also possible to obtain the same effect even in the case of the antenna switch module using a single semiconductor chip instead of the one comprised of a plurality of semiconductor chips as shown in the embodiments.

As described in the description of the operation examples of the embodiments, the antenna switch module of the present invention can be used for the communication apparatus comprising a plurality of receiving portions or transmitting portions.

Figure 15:
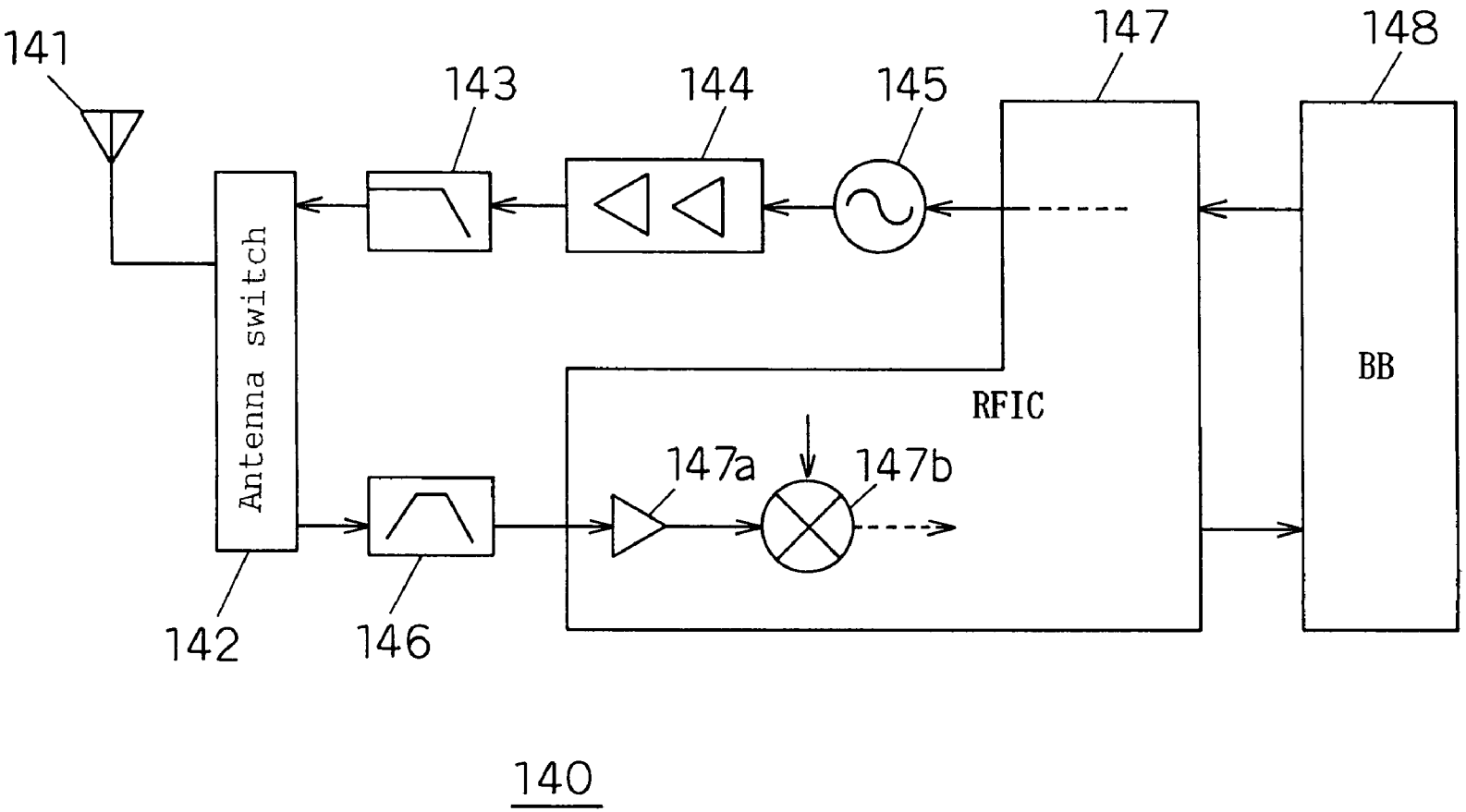
FIG. 15 is an RF block diagram of a single-band portable telephone.

Here, FIG. 15 shows an RF block diagram of a single-band portable telephone as an example of the communication apparatus of the present invention. As shown in FIG. 15, a single-band portable telephone 140 comprises an antenna 141, and an antenna switch 142 for switching between the transmitting signals and receiving signals inputted and outputted via the antenna. It also comprises a low-pass filter (LPF) 143, a power amplifier (PA) 144 for supplying the transmitting signals to the low-pass filter 143 and a voltage-controlled oscillator (VCO) 145 for supplying the high-frequency signals amplified by the power amplifier 144 as a transmitting end, and a band pass filter (BPF) 146 as a receiving end while comprising an RFIC 147 integrating a low noise amplifier (LNA) 147*a*, a mixer 147*b* and so on and a base band (BB) portion 148 to be shared by the transmitting portion and the receiving portion. Of these, the antenna switch 142 can be implemented by the antenna switch module of each of the embodiments so as to obtain the portable telephone with a miniaturized and highly pressure-tight antenna switch. It is also possible to provide the LPF 143 and BPF 146 in the dielectric layered body of the antenna switch module.

Figure 16:
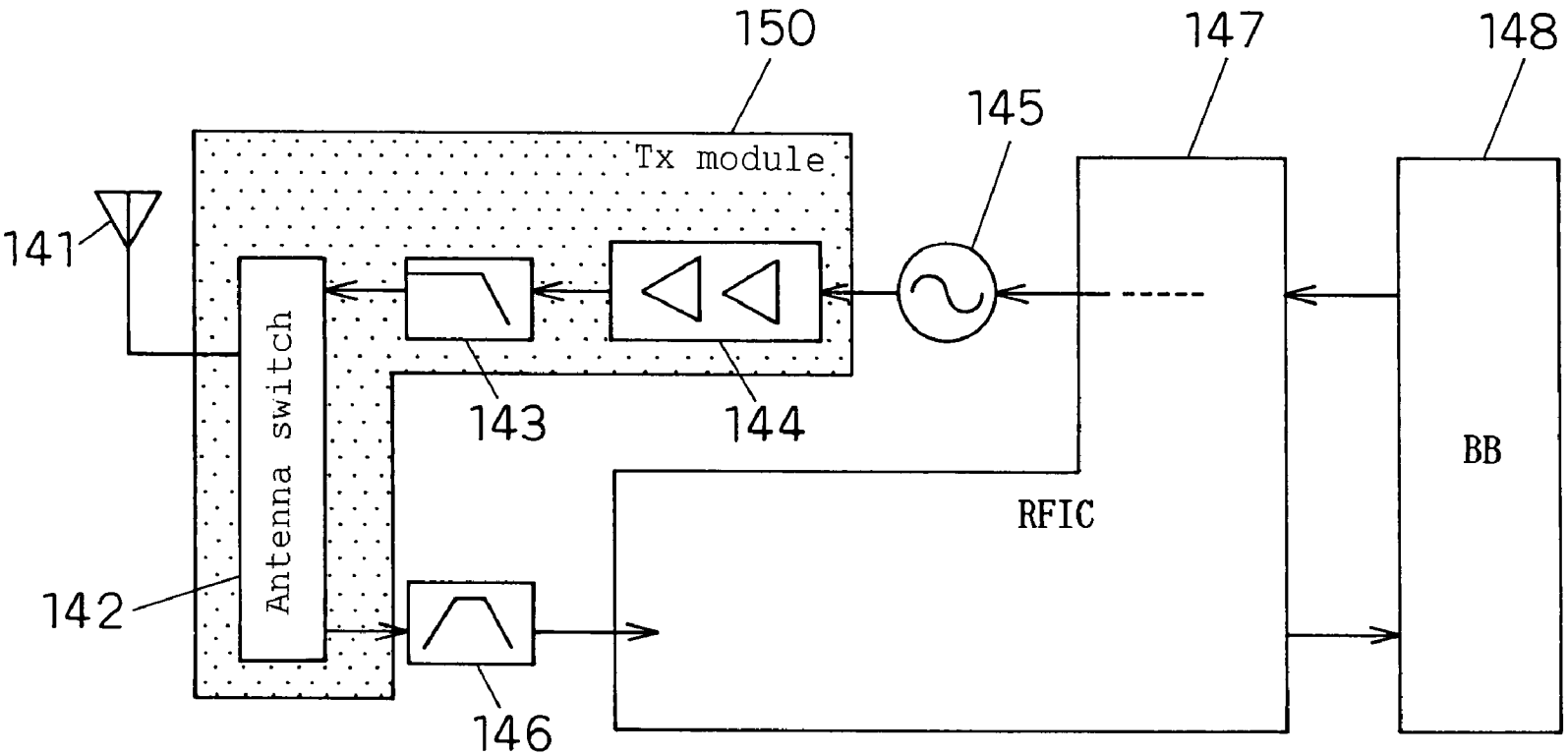
FIG. 16 is an RF block diagram of the single-band portable telephone including a Tx module according to the embodiment of the present invention.
Figure 17:
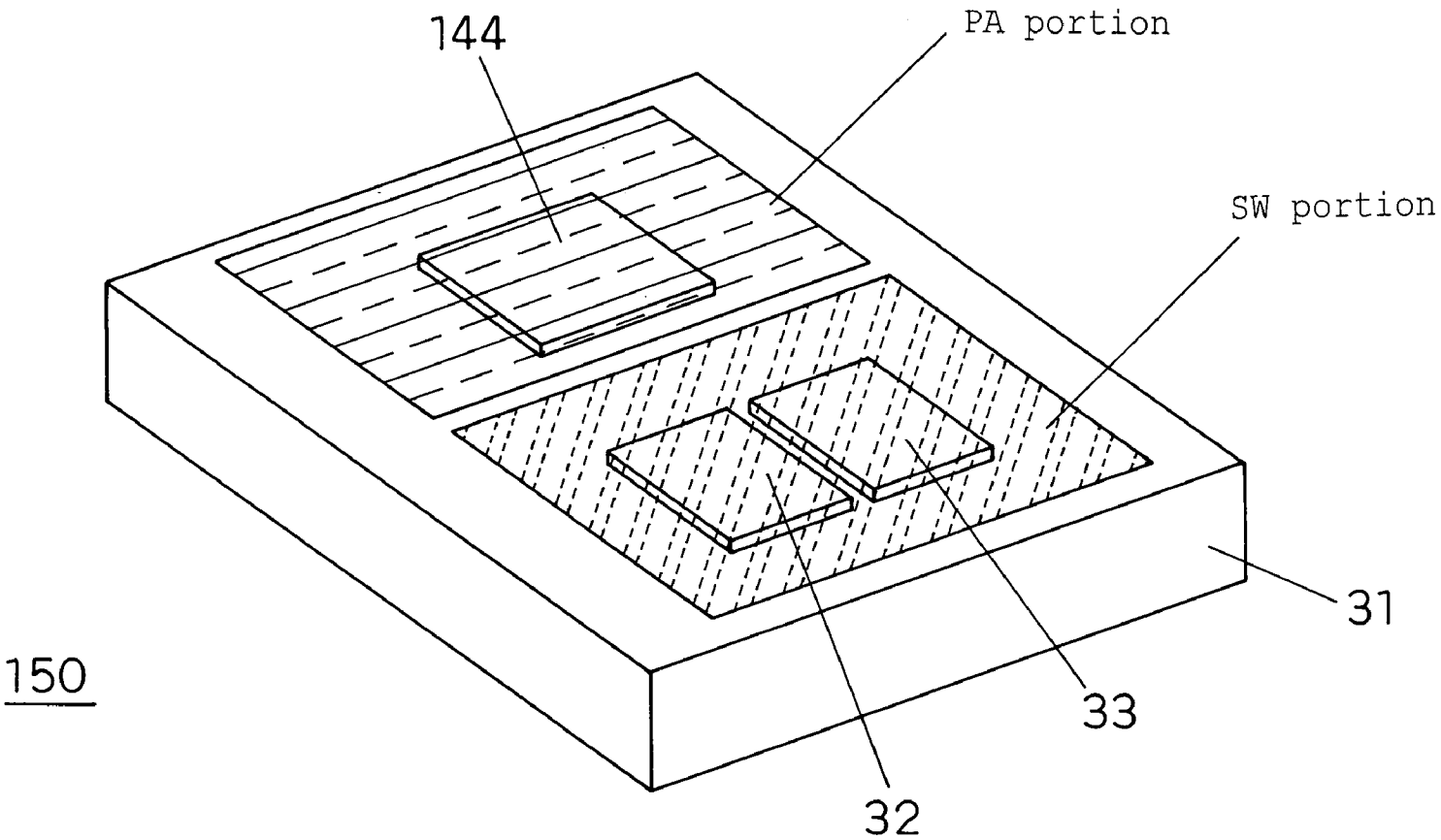
FIG. 17 is a perspective view of the Tx module according to the embodiment of the present invention.

Furthermore, as shown in FIG. 16, it is feasible to implement the antenna switch module of each of the embodiments as a Tx module 150 integrating the power amplifier 144 into the antenna switch module in addition to the LPF 143. In this case, as shown in FIG. 17, the power amplifier 144 is implemented on the same surface as that of the dielectric layered body 31 on which the logic semiconductor chip 33 and switch semiconductor chip 32 are placed. And though it is not shown, the LPF 143 is provided inside the dielectric layered body 31.

Figure 18:
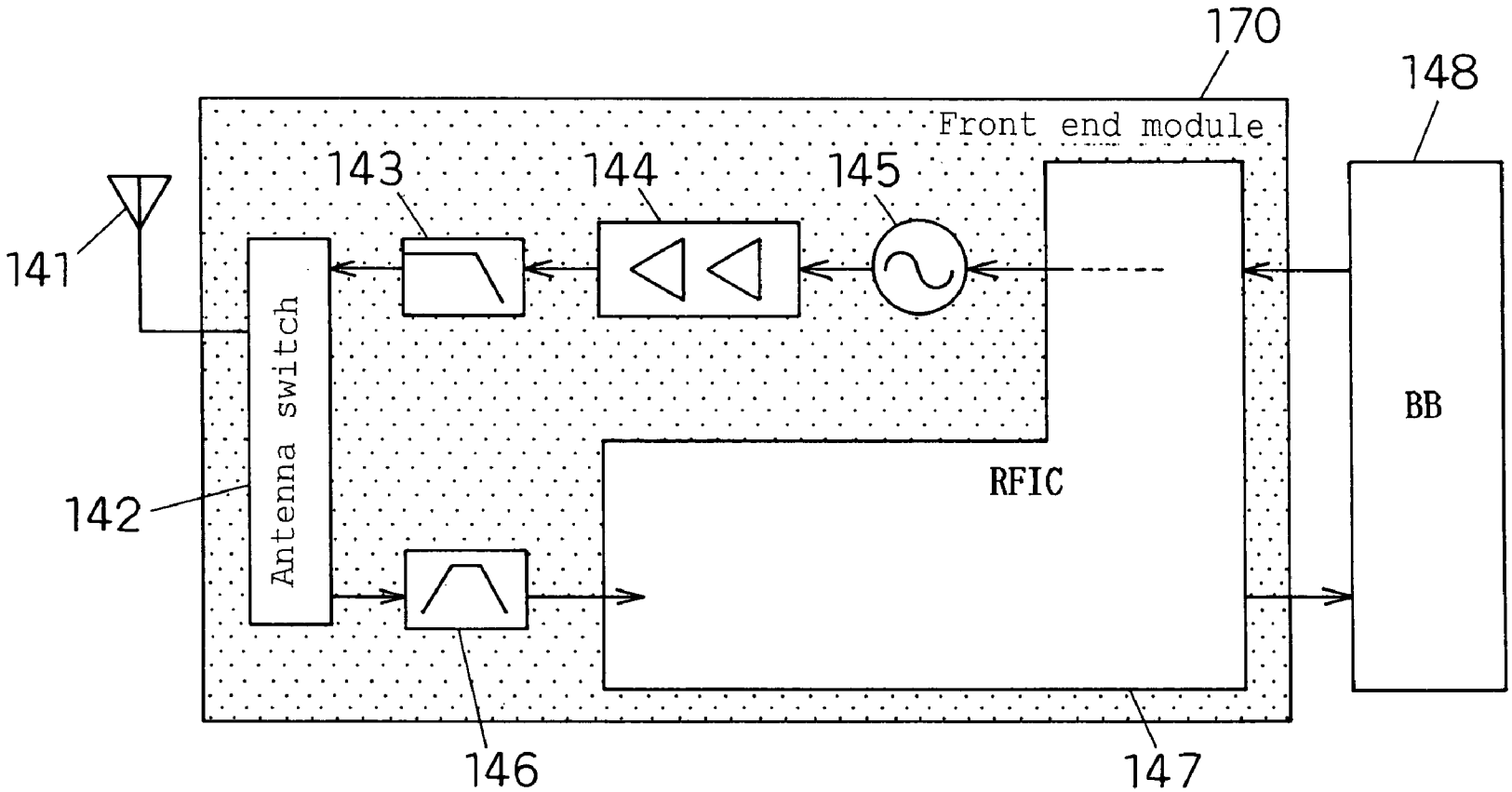
FIG. 18 is an RF block diagram of the single-band portable telephone including a front end module according to the embodiment of the present invention.
Figure 19:
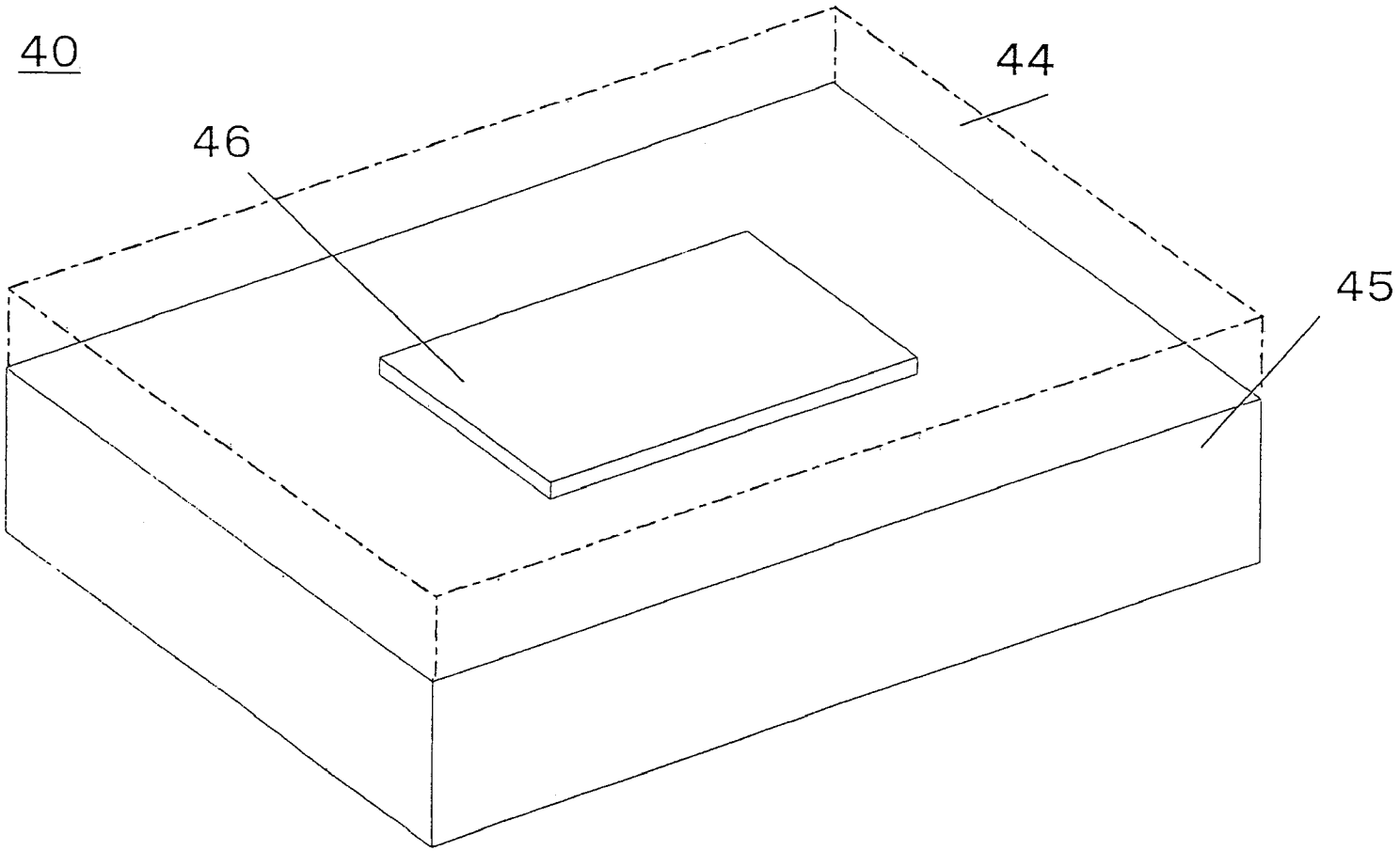
Fig. 19 PRIOR ART
FIG. 19 is a perspective view of the antenna switch module in the prior art.

Furthermore, as shown in FIG. 18, it is feasible to implement the antenna switch module of each of the embodiments as a front end module 170 further integrating the BPF 146 on the receiving end and the voltage-controlled oscillator 145 on the transmitting end. In this case, the VCO 145 is mounted on the same surface as that on which the logic semiconductor chip 33, switch semiconductor chip 32 and PA 144 are placed, and theBPF146 should be provided inside the dielectric layered body 31 as with the LPF 143. Furthermore, the portable telephone having the Tx module 150 and front end module 170 mounted thereon is included in the communication apparatus of the present invention. The above description took the single-band portable telephone as an example. However, it may also be a multi-band portable telephone. The Tx module 150 and front end module 170 in the above description are equivalent to an all-in-one communication module of the present invention.

As is apparent from the above description, the present invention has the effect that the capacitor is not destroyed and the high-frequency characteristic does not deteriorate even in the case where the high-voltage signal such as the electrostatic surge flows in.

The antenna switch module, all-in-one communication module, communication apparatus and method for manufacturing the antenna switch module according to the present invention have the effect that the capacitor is not destroyed and the high-frequency characteristic does not deteriorate even in the case where the high-voltage signal such as the electrostatic surge flows in, and are useful as the antenna switch module for high-frequency and high-power signals and applied products thereof for instance.

What is claimed is:

1. An antenna switch module comprising: a switch circuit for switching between transmitting and/or receiving of a signal between an antenna and a transmitting portion and/or a receiving portion and having a shunt circuit, wherein a capacitor of the shunt circuit of said switch circuit is provided by a dielectric layered body, and remaining elements of said switch circuit are provided by a semiconductor chip mounted on said dielectric layered body, wherein said semiconductor chip is mounted face down on a top surface of said dielectric layered body, and said dielectric layered body has a plurality of dielectric sheets including a first dielectric sheet on which a first electrode pattern connected to a ground potential is formed and a second dielectric sheet on which a second electrode pattern placed opposite said first electrode pattern is formed, and said capacitor is formed between said first electrode pattern and said second electrode pattern.

2. The antenna switch module according to claim 1, wherein an electrical connection between said semiconductor chip and said dielectric layered body is made in a surface of said semiconductor chip if projectively viewed from the top surface of said dielectric layered body.

3. The antenna switch module according to claim 1, wherein said semiconductor chip is mounted by wire bonding.

4. The antenna switch module according to claim 1, wherein said first electrode pattern is provided closer to said semiconductor chip than said second electrode pattern in said dielectric layered body.

5. The antenna switch module according to claim 1, wherein said second electrode pattern is provided closer to said semiconductor chip than said first electrode pattern in said dielectric layered body.

6. The antenna switch module according to claim 1, wherein said first dielectric sheet is placed on said dielectric layered body except its top layer, and said first electrode pattern has a shape for including at least the entire contours of said semiconductor chip if projectively viewed from the top surface of said dielectric layered body.

7. The antenna switch module according to claim 6, wherein, on said dielectric layered body, a third electrode pattern formed on a third dielectric sheet placed on said first dielectric sheet overlapping said first electrode pattern if projectively viewed from the top surface is connected to a fourth electrode pattern formed on a fourth dielectric sheet placed under said first dielectric sheet through an opening formed on said first electrode pattern so as not to short the ground potential.

8. The antenna switch module according to claim 5, wherein said third electrode pattern is connected to an arbitrary terminal of said semiconductor chip, and said fourth electrode pattern is the same as said second electrode pattern.

9. The antenna switch module according to claim 1, wherein said switch circuit has one pair or a plurality of pairs of a first field-effect transistor and a second field-effect transistor, and each of said pairs has a drain terminal of said first field-effect transistor connected to a source terminal of said second field-effect transistor and the drain terminal of said second field-effect transistor connected to a ground potential via said capacitor.

10. The antenna switch module according to claim 1, wherein said switch circuit has one pair or a plurality of pairs of a first field-effect transistor and a second field-effect transistor, and each of said pairs has a source terminal of said first field-effect transistor connected to a drain terminal of said second field-effect transistor and the source terminal of said second field-effect transistor connected to a ground via said capacitor.

11. The antenna switch module according to claim 1, wherein a combination of electrode patterns of certain dielectric sheets of said plurality of dielectric sheets forming said dielectric layered body forms one high-frequency filter or a plurality of high-frequency filters.

12. The antenna switch module according to claim 11, wherein said first electrode pattern has a shape for including all the electrode patterns of said certain dielectric sheets forming said high-frequency filters if projectively viewed from the top surface of said dielectric layered body.

13. An all-in-one communication module comprising:

the antenna switch module according to claim 1;

a low-pass filter of said transmitting portion provided in said dielectric layered body; and a power amplifier for supplying a transmitting signal to said low-pass filter provided on said dielectric layered body.

14. The all-in-one communication module according to claim 13, further comprising:

a band pass filter of said receiving portion provided in said dielectric layered body; and a voltage-controlled oscillator for supplying a transmitting signal to said power amplifier on the transmitting side provided on said dielectric layered body.

15. A communication apparatus comprising:

the antenna switch module according to claim 1;

an antenna connected to said antenna switch module;

the transmitting portion for supplying the transmitting signal to said antenna switch module; and the receiving portion.

16. A communication apparatus comprising:

the all-in-one communication module according to one of claims 13 and 14; and an antenna connected to said low-pass filter and/or said band pass filter.

17. A method for manufacturing an antenna switch module comprising a switch circuit for switching between transmitting and receiving of a signal between an antenna and a transmitting portion or a receiving portion and having a shunt circuit, wherein the method comprises the steps of:

placing a capacitor of the shunt circuit of said switch circuit on a dielectric layered body; and placing remaining elements of said switch circuit on a semiconductor chip mounted on said dielectric layered body;

wherein said dielectric layered body is manufactured by laminating a plurality of dielectric sheets including a first dielectric sheet on which a first electrode pattern connected to a ground potential is formed and a second dielectric sheet on which a second electrode pattern placed opposite said first electrode pattern is formed, and said capacitor is formed between said first electrode pattern and said second electrode pattern.

18. The method for manufacturing the antenna switch module according to claim 17, wherein said semiconductor chip is mounted face down on a top surface of said dielectric layered body.

* * * * *